US007491037B2

(12) United States Patent
Edwards

(10) Patent No.: US 7,491,037 B2
(45) Date of Patent: Feb. 17, 2009

(54) REVERSIBLE VALVING SYSTEM FOR USE IN PUMPS AND COMPRESSING DEVICES

(76) Inventor: Thomas C. Edwards, 1426 Gleneagles Way, Rockledge, FL (US) 32958

( * ) Notice: Subject to any disclaimer, the term of this patent is extended or adjusted under 35 U.S.C. 154(b) by 479 days.

(21) Appl. No.: 11/198,773

(22) Filed: Aug. 5, 2005

(65) Prior Publication Data

US 2007/0031278 A1 Feb. 8, 2007

(51) Int. Cl.
*F04B 19/00* (2006.01)
*F04B 37/00* (2006.01)

(52) U.S. Cl. ..... 417/315; 418/63; 62/324.6

(58) Field of Classification Search ..... 417/315, 417/326; 418/161, 771, 63, 177; 62/324.6
See application file for complete search history.

(56) References Cited

U.S. PATENT DOCUMENTS 3,985,473 A * 10/1976 King et al. ..... 417/315
4,076,046 A * 2/1978 Hieronymus et al. ..... 137/627.5
4,111,618 A 9/1978 Thibault
4,367,638 A * 1/1983 Gray ..... 62/324.6
4,598,559 A * 7/1986 Tomayko et al. ..... 62/324.6
4,844,703 A * 7/1989 Watanabe et al. ..... 417/295
4,966,531 A * 10/1990 Suzuki et al. ..... 417/295
5,380,176 A * 1/1995 Kikuchi et al. ..... 418/55.1
5,421,368 A * 6/1995 Maalouf et al. ..... 137/856
5,836,349 A * 11/1998 Kimberly et al. ..... 137/493.8
6,371,745 B1 4/2002 Bassine
6,641,373 B2 * 11/2003 Morita ..... 417/310
6,749,405 B2 * 6/2004 Bassine ..... 417/313
7,114,932 B1 10/2006 Bassine (Continued)

FOREIGN PATENT DOCUMENTS

JP 2006-083767 3/2006

OTHER PUBLICATIONS

'Compressed Air Tutorial' Energy Solutions Center Technology Training, [online], 2005, 4 pages [retrieved on Jun. 21, 2005 ]. Retrieved from Internet, <http://www.energysolutionscenter.org/Learn/Air_Compressor_Tutorial.htm<.

(Continued)

*Primary Examiner*—Charles G Freay
*Assistant Examiner*—Peter J Bertheaud
(74) *Attorney, Agent, or Firm*—Brian S. Steinberger; Phyllis K. Wood; Law Offices of Brian S. Steinberger, P.A.

(57) ABSTRACT

A valving system for reversing flow in a compressing device. The reversible compressor includes a reversible drive motor for reversing a rotational direction of a rotor, a first and second port located in a left and right side of a stator, respectively, and a first and second manifold located on a right a left side of said reversible compressor, the first and said second manifold includes a corresponding first and second inlet valve moveable between an open and closed position. A valving system between said first and said second manifold switches one of the first and second inlet valve to an open position to open a corresponding first or the second port for directional flow corresponding to the rotational direction of the rotor. In a first embodiment the valving system is a pressure-actuated control element and in a second embodiment the valving system includes a solenoid.

12 Claims, 25 Drawing Sheets

U.S. PATENT DOCUMENTS

2002/0092316 A1 7/2002 Kidwell

OTHER PUBLICATIONS

'Reciprocating Air Compressor', *Vikay Mining Equipments* [Online]. 2005, pp. 1 and 2, [retrieved on Jun. 21, 2005] Retrieved from Internet electronic mail: Vikay Minig Equipments.

'Air Compressor Types' The Engineering Tool Box [online]. 2005, 2 pages, [retrieved on Jun. 21, 2005]. Retrieved from Internet: www.EngineeringToolBox.com: <http//www.engineeringtollbox.com/air-compressor-tyoes-22_441.html<.

* cited by examiner

REVERSIBLE VALVING SYSTEM FOR USE IN PUMPS AND COMPRESSING DEVICES

FIELD OF THE INVENTION

This invention relates to compressors and, in particular, to methods, systems, apparatus and devices for providing reversible valving for compressing devices such as those used in air conditioners and frost-free refrigerators.

BACKGROUND AND PRIOR ART

An air conditioning and refrigeration system consists of a relatively simple group of components that, collectively, are capable of transferring heat, through an intermediate fluid substance known as a refrigerant, from a relatively cool environment to a relatively warm environment. However, when the basic thermodynamics of air conditioning or refrigeration is applied to reversing this heat flow from inside-to-outside to outside-to-inside' without a reversible compressor, a heat pump is required, increasing the complexity of the air conditioner with additional system plumbing, solenoid valving, controls, etc.

The basic capability of an air conditioning (cooling) system that is also able to supply heating (a heat pump), lies within the compressor. Conventional compressors are not flow-reversible devices. In a system capable of cooling only, for example, the hot discharge refrigerant gas is routed directly to the heat exchanger residing in the relatively warm outside environment where relatively high-energy (high enthalpy) hot discharge refrigerant gas is condensed isothermally to a liquid due to the heat being transferred to the outside environment by a heat exchanger, referred to as a condenser.

The relatively warm, condensed (liquid phase), high pressure refrigerant then flows through a small orifice, known as an expansion valve, and into another heat exchanger (known as the evaporator) that is located within the cooled space, and is operating at low pressure because of the "suction" provided by the inlet flow into the intake of the compressor. A physical phenomenon, known as the Joule-Thompson effect, takes place as the liquid refrigerant that passes through the expansion valve becomes very cool due to the significant pressure differential it experiences as it flows across the orifice.

Because of a drop in the pressure the refrigerant experiences as it flows through the expansion valve, a portion of the liquefied (condensed) refrigerant leaving the expansion valve flashes into a vapor phase. This rapid drop in refrigerant pressure results in the flashed vapor and the remaining liquid refrigerant to become relatively cold. The remaining cold, low-pressure refrigerant flows through the evaporator where it absorbs heat from the air in the cooled space it is located in, causing the refrigerant to evaporate into its gaseous phase. The refrigerant then reenters the inlet of the compressor where the cycle repeats.

Conventional compression devices and valving systems are unable to exchange the inlet port for the outlet port by reversing the machine's rotational direction. In other words, conventional compression devices are not flow-reversible. In certain applications, such as air conditioning and heat pump systems, true compressor reversibility would be of exceptional value.

Since conventional compressors are not flow-reversible, when it is necessary to transfer heat from the outside environment to the inside to provide heating, additional hardware is required. The hot gas discharging from the compressor is re-routed from flowing to the outside heat exchanger to the inside heat exchanger through the use of additional plumbing and electrical solenoid valves, as described above. Subsequently, heat transferred to the inside heated space results in the condensation of the hot refrigerant gas to liquid form.

This relatively warm liquid refrigerant is required to be re-routed through additional plumbing, valving and controls to the outside environment heat exchanger after it passes through an expansion valve where the Joule-Thompson effect re-occurs causing the refrigerant to be colder than the outside environment. Due to the temperature difference, heat is absorbed through the heat exchanger that is now behaving as an evaporator.

As the environmental heat residing in the cool or cold outside is being transferred to the outside heat exchanger, the refrigerant evaporates as it absorbs the heat and returns to the gaseous phase. Having converted to a gas as a result of absorbing heat, the refrigerant re-enters the compressor inlet through additional plumbing, valving and controls; again, bringing the system to cyclic repetition.

On the other hand, if the refrigerant compressor had the capability to reverse its flow, the air conditioner would become a heat pump without requiring the additional plumbing, valving, controls, etc., required by conventional heat pumps. Since conventional compression devices and valving systems are unable to exchange the inlet port for the outlet port by reversing the rotational direction of the machine, they are not flow-reversible. In certain applications, such as air conditioning and heat pump systems, true compressor reversibility would be of exceptional value. For these reasons, a need exists for a reversible valving system for use in compressor devices.

SUMMARY OF THE INVENTION

A primary objective of the invention is to provide a new method, system, apparatus and device for providing a reversible valving system for use in compression devices such as used in air conditioners.

A secondary objective of the invention is to provide methods, systems, apparatus and devices for exchanging the inlet port for the outlet port, and vice versa, by reversing the machine's rotational direction.

A third objective of the invention is to provide methods, systems, apparatus and devices for reducing the complexity of a system providing air conditioning and heating.

A fourth objective of the invention is to provide a method, system, apparatus and device for providing heating air conditioning, frost-free refrigeration, systems at a reduced cost.

A first embodiment of the invention provides a reversible compressor. The reversible compressor includes a reversible drive motor for reversing a rotational direction of a rotor, a first and a second port located in a left side and a right side of a stator, respectively, and a first and a second manifold located on a right side and a left side of said reversible compressor, said first and said second manifold having a corresponding first and second inlet valve moveable between an open and a closed position.

A valving system located between said first and said second manifold switches one of the first and the second inlet valve to an open position to open corresponding to the position of the first port and the second port for directional flow corresponding to the rotational direction of the rotor. In a first embodiment the valving system is a pressure-actuated control element and in a second embodiment the valving system includes a solenoid.

Further objects and advantages of this invention will be apparent from the following detailed description of preferred embodiments which are illustrated schematically in the accompanying drawings.

DESCRIPTION OF THE PREFERRED EMBODIMENTS

Figure 1A:
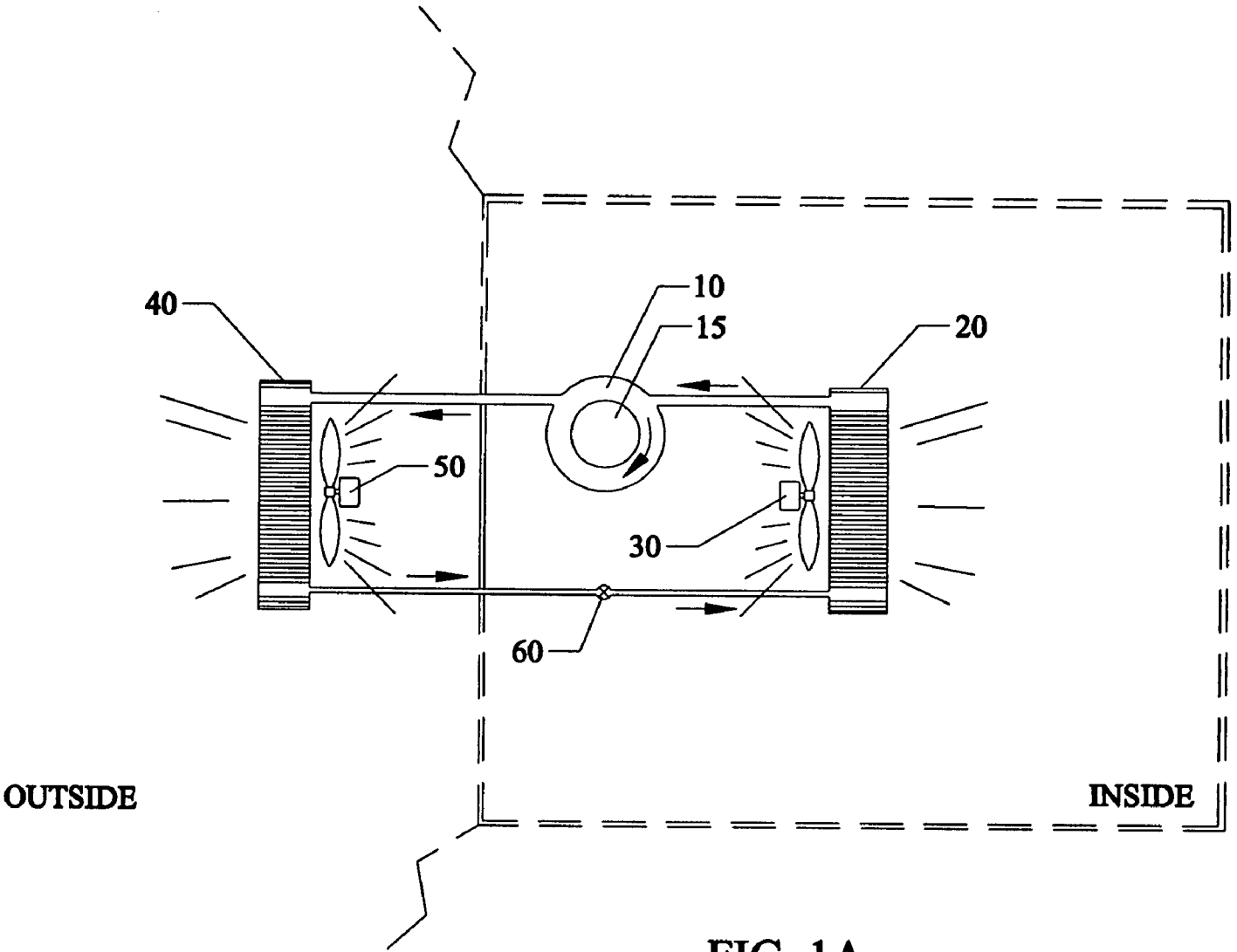
FIG. 1*a* is a schematic diagram showing the operation of a vapor refrigeration/air conditioning cycle for cooling.

Before explaining the disclosed embodiments of the present invention in detail it is to be understood that the invention is not limited in its application to the details of the particular arrangements shown since the invention is capable of other embodiments. Also, the terminology used herein is for the purpose of description and not of limitation.

The following is a list of the reference numbers used in the drawings and the detailed specification to identify components:

| | |
|---|---|
| 10 | flow reversible compressor |
| 15 | reversible motor |
| 20 | inside heat exchanger/condenser |
| 30 | fan |
| 40 | outside heat exchanger/condenser |
| 50 | fan |
| 60 | expansion valve |
| 100 | left endplate |
| 102 | rotor shaft |
| 105 | rotor ball bearing |
| 110 | stator housing |
| 120 | right endplate |
| 125 | rotor shaft bearing |
| 130 | rotor |
| 132 | vane slot |
| 139 | vane slot |
| 140 | vane |
| 141 | vane radial control rod |
| 145 | vane |
| 146 | vane radial control rod |
| 160 | roller bearings |
| 163 | roller bearings |
| 164 | second radial control rod |
| 170 | vane ring |
| 171 | vane ring |
| 172 | vane ring |
| 173 | vane ring |
| 174 | vane axles |
| 180 | reed control valve rods |
| 185 | passageway |
| 190 | stator body extension |
| 200R | right reed valve |
| 200L | left reed valve |
| 210R | right reed valve stop |
| 210L | left reed valve stop |
| 230 | right side manifold |
| 240 | left side manifold |
| 250R | compressor inlet port |
| 250L | compressor inlet port |
| 260R | right back-up plate |
| 260L | left back-up plate |
| 300 | solenoid |
| 320 | return spring |
| 400 | rolling piston stator body |
| 402 | endplate |
| 404 | shaft side endplate |
| 405 | vane control guide |
| 410 | rolling piston drive shaft |
| 420 | rolling piston eccentric |
| 430 | rolling piston |
| 440 | left flow passage |
| 445 | left manifold region |
| 450 | right flow passage |
| 455 | right manifold region |
| 460 | vane |

-continued

| | |
|---|---|
| 462 | vane slot |
| 470 | vane spring |
| 480 | hydraulic pressure hole |
| 490L | left reed valve back-up plate |
| 490R | right reed valve back-up plate |
| 493L | left electro-magnet |
| 493R | right electro-magnet |
| 494L | left reed valve |
| 494R | right reed valve |
| 495 | electrical leads |
| 500 | rolling piston stator |
| 510L | left valve control pin |
| 510R | right valve control pin |
| 520L | left valve pin spring |
| 520R | right valve pin spring |
| 531 | pressure transmission passage |
| 540L | left cross pressure hole |
| 540R | right cross pressure hole |
| 545 | left manifold |
| 550L | left reed back-up plate |
| 550R | right reed back-up plate |
| 555 | right manifold |
| 560L | left reed valve |
| 560R | right reed valve |

The methods, systems, apparatus and devices of the present invention provide reversible valving systems for reversing the flow direction and gas delivery of compressors simply by switching the compressor's rotational direction. In a first embodiment, the reversible valving system includes a dual set of valving systems, one on each side of the compressor body, dual sets of compatible flow ports installed in the stator, dual set of identical and compatible manifolds enclosing the reed valves and ports, and rod-shaped valve control elements in the stator extension, that moves from one side to the other side due to pressure build-up. Depending upon the rotational direction, an extended top region of the stator housing is needed to accommodate valve reversing rods. The extension is either a casting extension on the stator body or a separate extender device fastened to the stator body.

Figure 1B:
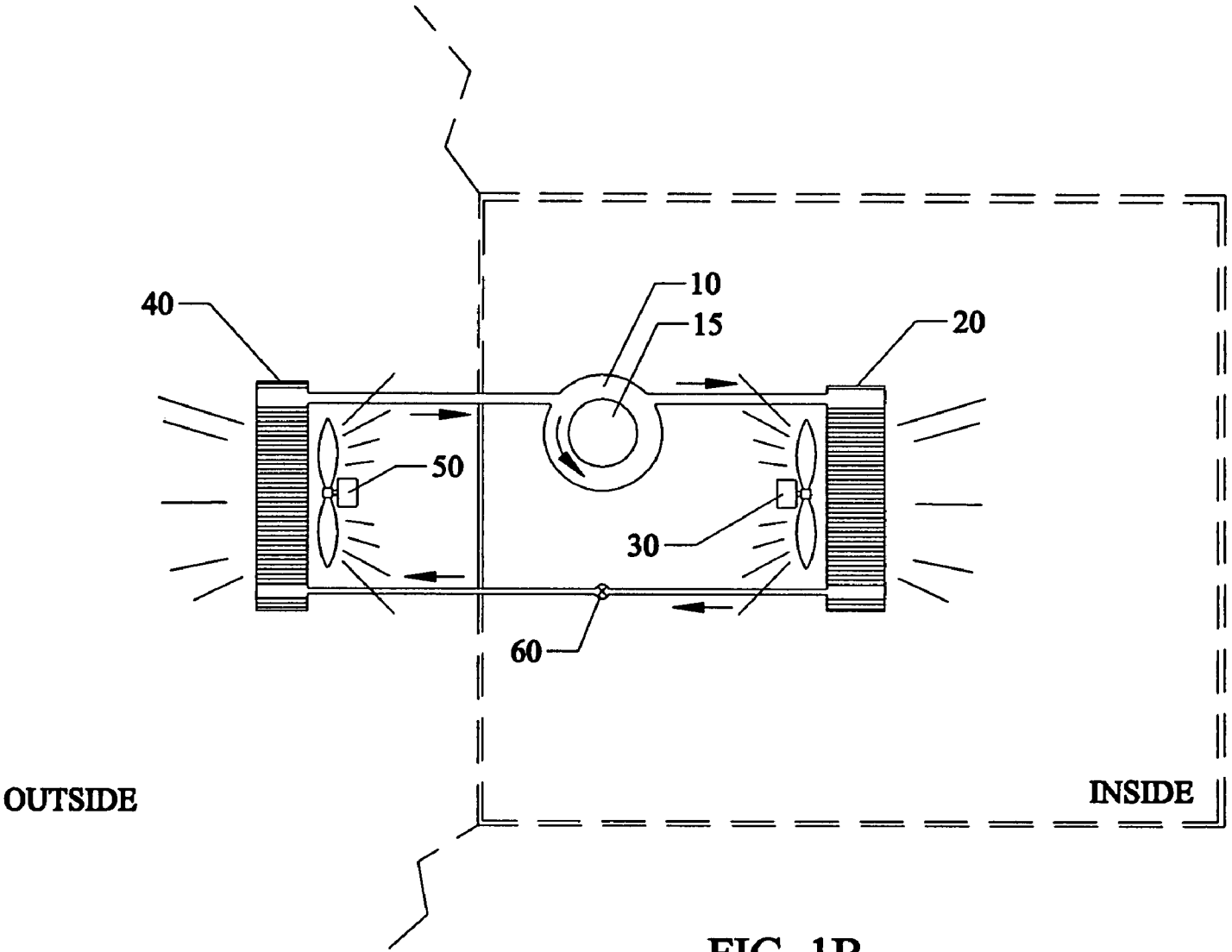
FIG. 1*b* is a schematic diagram showing the operation of a vapor refrigeration/air conditioning cycle for heating.

FIGS. 1*a* and 1*b* illustrate the operation the reversible flow compressor of the present invention in delivering both cooling and heating. FIG. 1*a* shows the operation of a vapor refrigeration/air conditioning cycle for cooling. As shown, if a reversible-flow compressor 10, driven by the reversible motor 15 for example, is turning clockwise, it draws refrigerant from the inside heat exchanger 20 that has evaporated due to the heat it has absorbed from the cooled environment due to air flow generated by fan 30 as indicated by the arrows. The refrigerant, now in the gas phase, is compressed by the compressor 10 and delivered to the outside heat exchanger 40, where it is condensed to a liquid form as a result of the heat being rejected to the outside environment. Next, the high pressure condensed refrigerant liquid passes through the expansion valve 60 where the liquid refrigerant is cooled significantly due to the change in pressure developed by the compressor 10 operating clockwise, and then flows to the inside heat exchanger 20 where it absorbs heat from the space being cooled.

As shown in FIG. 1*b*, when the flow-reversible compressor 10 reverses to a counter-clockwise rotational flow as indicated by the arrows, the system delivers hot compressed gas to the inside heat exchanger 20. As the hot refrigerant gas flows through heat exchanger 20, it condenses due to the heat it delivers to the space that is now being heated. In the previous example having clockwise rotation, the refrigerant was being cooled as it flowed through the heat exchanger 20. The condensed high pressure liquid refrigerant then flows through the expansion valve 60. As previously described, the refrigerant becomes relatively cold due to the Joule-Thompson effect as it passes into the low pressure field in the outside heat exchanger 40.

As cold low-pressure refrigerant flows into the outside heat exchanger 40 it accepts heat from the outside environment as the fan 50 forces the air flow toward the outside environment and the refrigerant evaporates into its gaseous phase. The cool refrigerant gas then re-enters the reversible-flow compressor 10 where it is re-compressed and delivered to the inside heat exchanger 20, thus continuing the cycle.

Figure 2B:
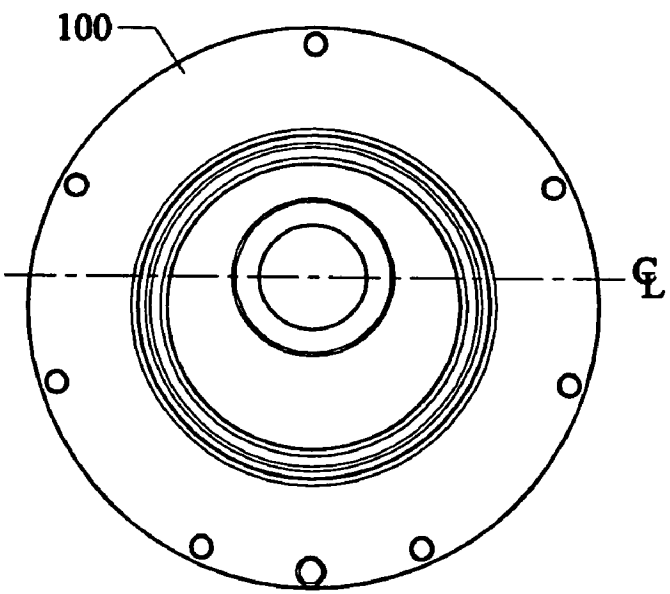
FIGS. 2*b*, 2*c*, 2*d*, 2*e* and 2*f* are disassembled expanded views of an automatic reversible pressure-activated valving system shown in FIG. 2*a* according to an embodiment of the invention.
Figure 2A:
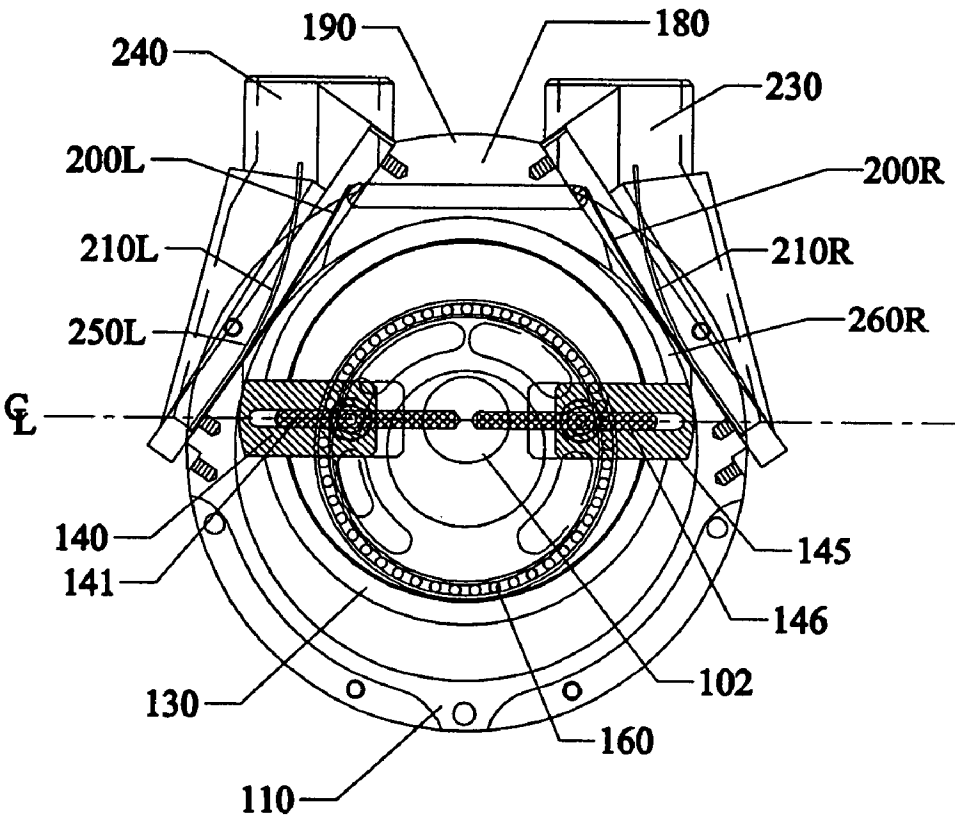
FIG. 2*a* is a front view of a novel non-contact sealing DuoVane compressor.

FIG. 2*a* is front sectional view of the reversible compressor according to a first embodiment. In this example, the reversible valving system is incorporated into a DuoVane compressor that uses outer roller vane bearings to dictate their accurate radial location. The centerline in FIG. 2*a* follows through to FIGS. 2*b-f* showing corresponding expanded, and disassembled, views of an automatic reversible pressure-activated valving system fitted to a DuoVane compressor according to a first embodiment of the present invention. As shown, the machine is in a neutral, non-rotating, position with the right and left inlet valves 210R, 210L held partially open.

Figure 2D:
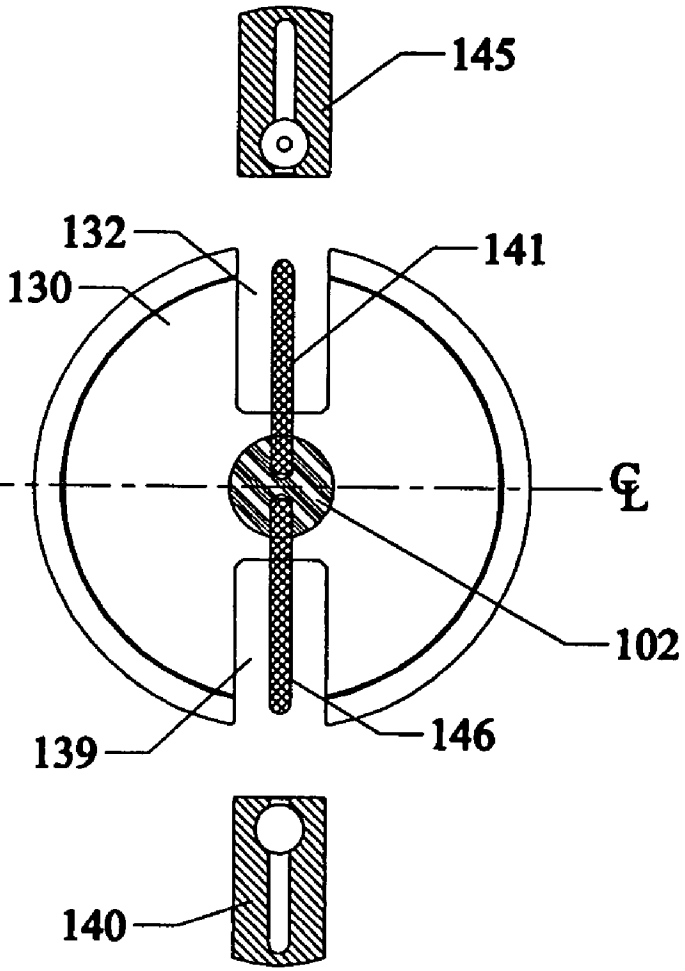
Figure 2C:
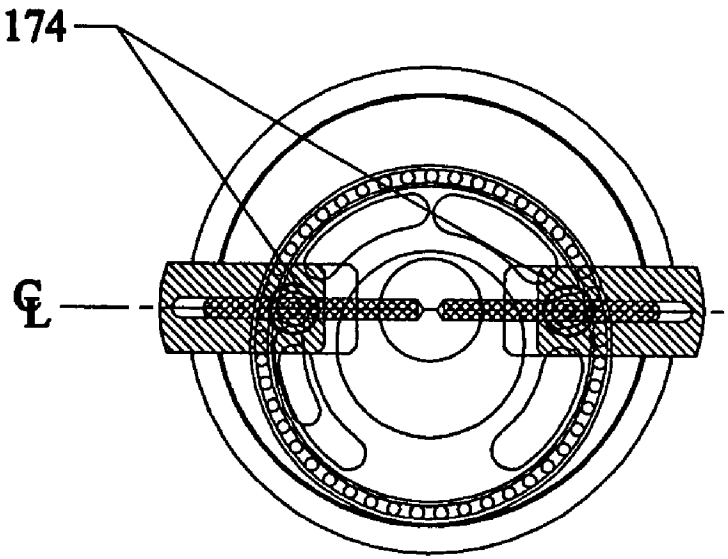
Figure 2F:
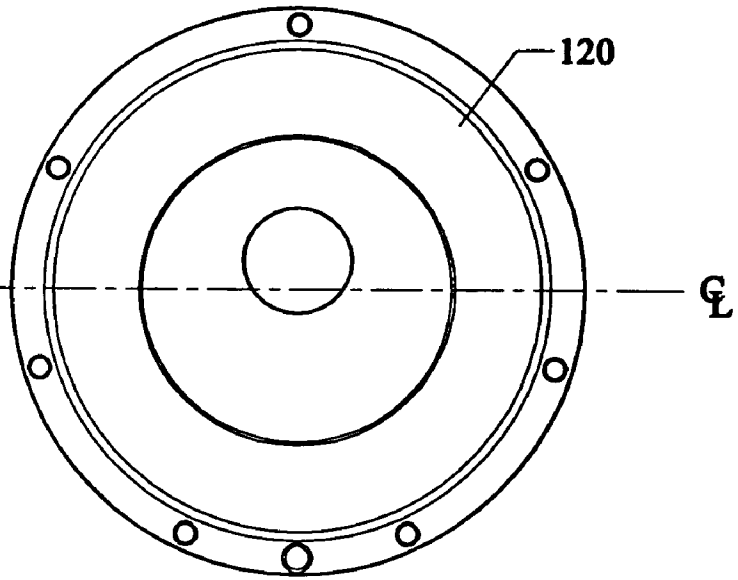
Figure 2E:
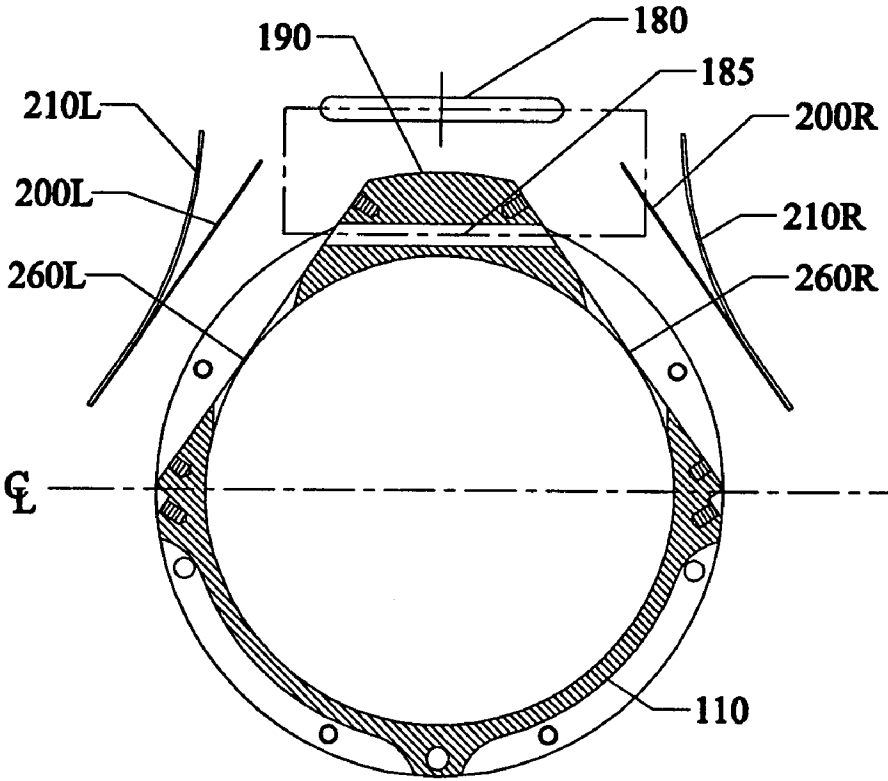
Figures 3A, 3B:
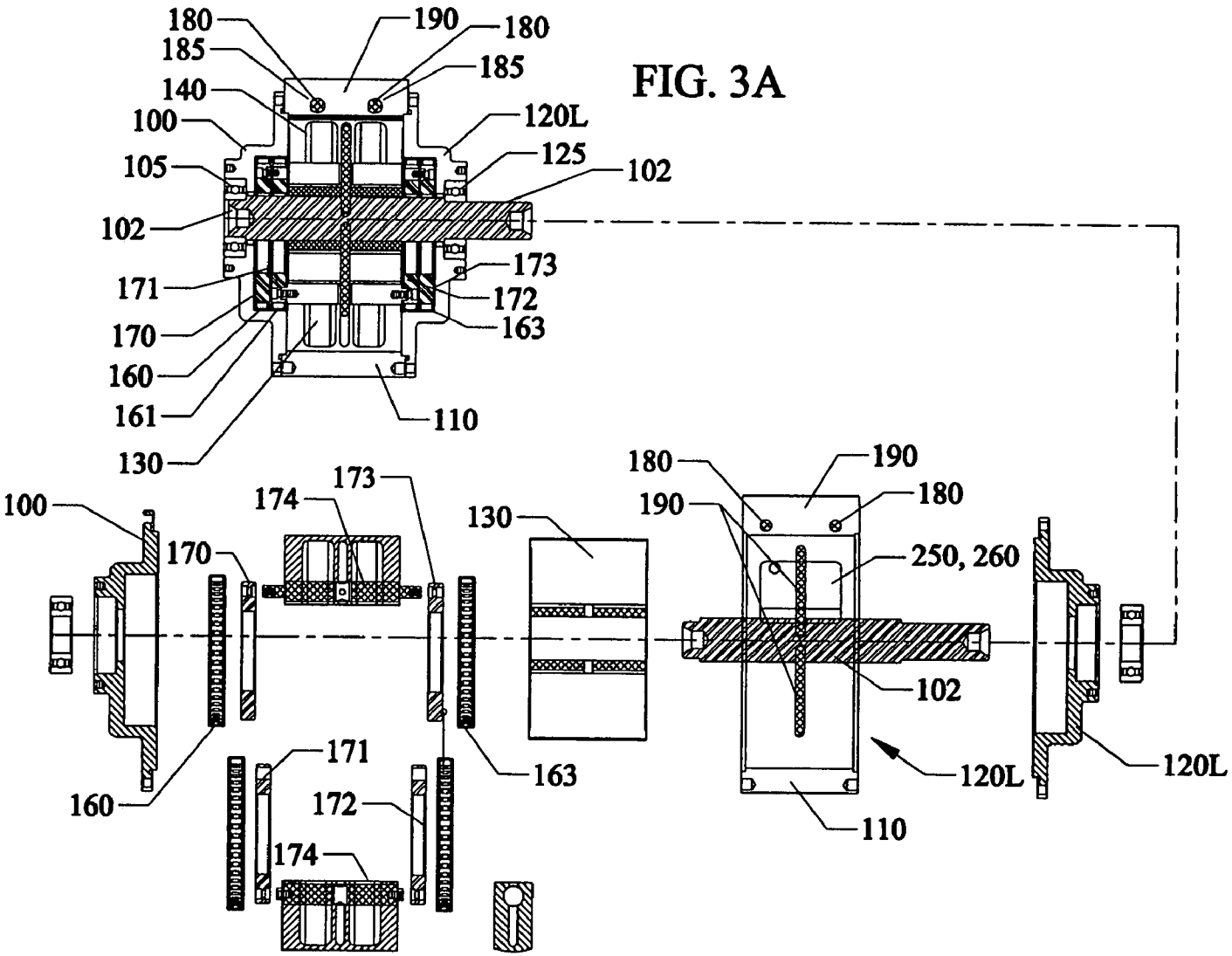
FIG. 3*a* is a side sectional view of the novel DuoVane compressor shown in FIG. 2*a*.
FIG. 3*b* are disassembled and expanded view of the compressor shown in FIG. 3*a*.

FIG. 3*a* is a cross-sectional side view of the same reversible compressor and FIG. 3*b* shows the corresponding expanded, and disassembled, cross-sectional views of the compressor. Referring again to FIGS. 2*b*-2*f*, note that as is generally typical of vane-type machines, the left-hand endplate 100 houses rotor ball bearing 105 into which fits rotor shaft 102. Left endplate 100 and right endplate 120 are connected to stator housing 110 by conventional means and the right endplate 120 encases rotor shaft bearing 125. This configuration is shown in the disassembled cross-sectional views in both FIG. 2*a* and FIG. 3*a*. The stator housing 110 is shown cross-hatched and the reed control rod 180 is shown removed from the corresponding passageway 185 in FIG. 2*c*. Fig. The thin spring-steel reeds 200R and 200L and their corresponding reed valve stops 210R, 210L and back-up plates 260R, 260L are shown in FIG. 2.

As shown in FIG. 2*d*, rotor 130 attached to rotor shaft 102 is equipped with two approximately equal and opposite vane slots 132 and 139 fitted respectively with vanes 140 and 145. The axial positioning of vanes 140 and 145 within the stator cavity is controlled by radial control rods 141 and 146, respectively, while roller bearings 160 through roller bearing 163, in concert with vane rings 170 through 173 and the vane axles 174 insure that the vane tips do not touch the circular bore of stator housing 110 as shown in FIG. 3*b*. Nor do the vanes 140, 145 contact the inner operating surfaces of endplates 100 and 120 since the control rods 141 and 146 are firmly and accurately placed in rotor shaft 102 operating within the mating radial holes in the vanes 140 and 145.

In FIG. 3*a*, in neutral, the ends of slideable reed control rods 180 each press against the opposing reed valves due to the spring constant of the spring steel (or other suitable material) reed valves 200R and 200L cause the reed control rods 180 to approximately center within the passageways 185 in the stator body extension 190. The reed control rods 180 are sufficiently long to insure partial opening of both reeds valves 200R, 200L when not operating. Reed valve stops 210R and 210L prevent the reed valves 200R and 200L from over-deflecting during operation.

Figure 4A:
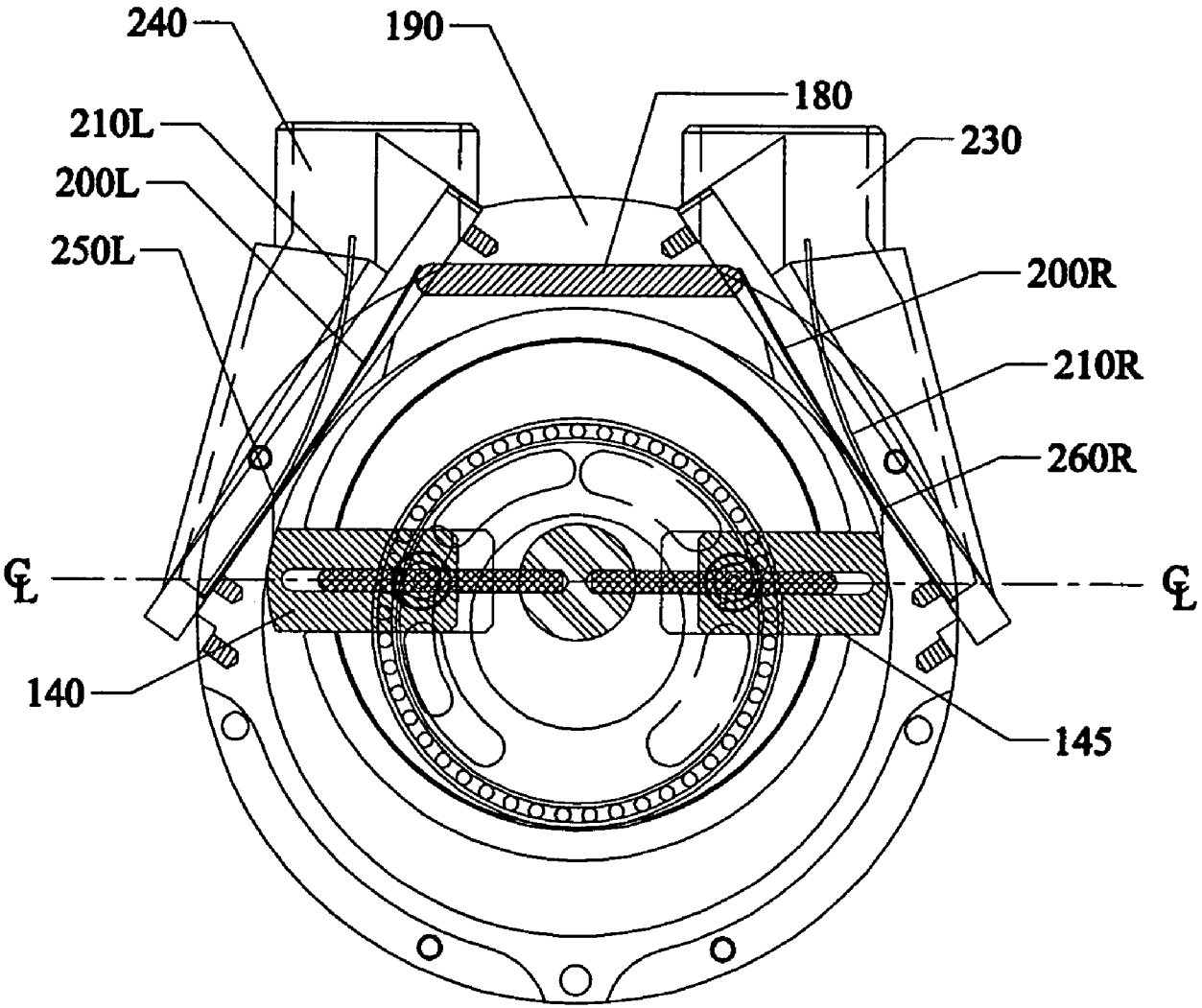
FIG. 4*a* shows the machine in a neutral position, with both valves in an open position.
Figure 4C:
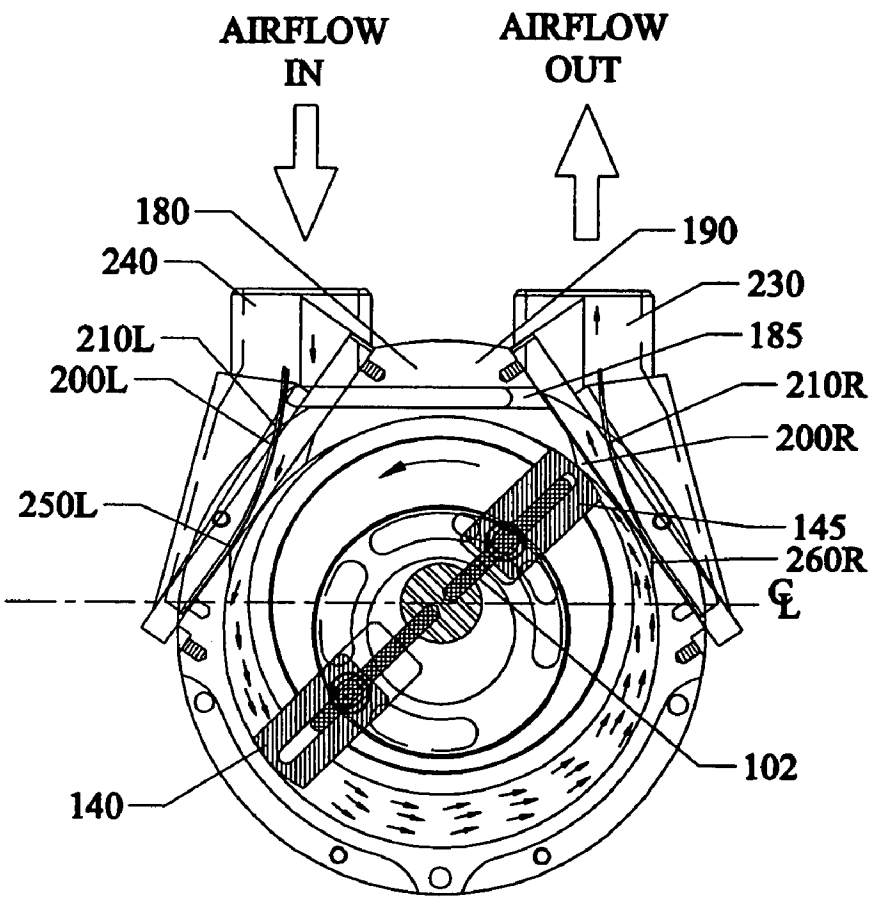
FIG. 4*c* shows the machine of FIG. 3*a* rotating in a counter-clockwise direction.

FIG. 4*a* shows the machine in neutral with both of the control valves 200R, 200L shown in a partially open position. FIG. 4*c* shows the machine operating in the counter-clockwise direction with the gas, or refrigerant, entering the left side of the compressor, through the left manifold 240 and into the compressor.

Referring next to FIG. 4*c* showing counter-clockwise rotation, in this example, the rotor vane assembly includes rotor shaft 102, rotor 130, vane set 140 and 145 along with corresponding vane guide posts 141 and 146. Since ports 250R and 250L, which are basically openings placed on opposing sides of the stator housing, are both open by the reed control rod 180 in the quiescent state. At start-up, again counter-clockwise operation in this example, the gas enters the machine through the right manifold 230 and, again because the left reed valve 200L is already partially open, gas continues to flow into the compressor during start-up, and is therefore gently pressurized and pumped out of the right side of the compressor pressurizing the internal region of the right manifold 230.

As the compressor reaches operating speed, the discharge pressure building in the right manifold 230 forces the reed valve control rod 180 leftward where left end of the reed control rod 180 forces the left reed valve 200L against the left reed valve stop 210L. The reed control rod 180 shifts because the pressure on the left ends of the reed control rods 180 is subject to considerably more force due to the relatively high pressure the reed control rod 180 experiences in comparison to the lower pressure on the inlet or left side. This action of the reed control rod 180 opens the inlet to the compressor port 250L and disengages the right reed valve 200R permitting it to operate normally. As the pressure in the right side of the compressor, within manifold 230 for example, rises above the pressure in the left manifold 240, the reed valve 210R opens letting the hot compressed gas flow out and through right compressor port 260R, into manifold 230 and, for example, into the inside condenser 20 as shown in FIG. 1*b*.

Figure 4B:
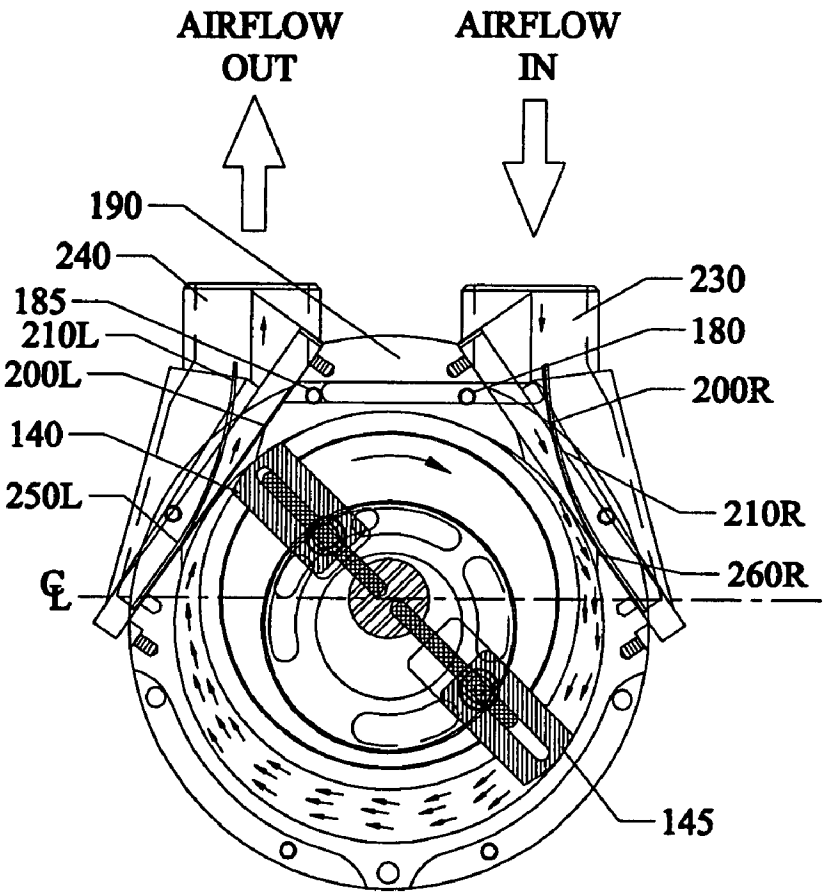
FIG. 4*b* shows the machine of FIG. 3*a* rotating in a clockwise direction.

FIG. 4*b* shows the compressor rotating clockwise causing the valving system to operate with inlet on the right side and discharge on the left side as shown. The refrigerant flows behind the vane 145 into the machine indicating compression in front of the vane 145. In this flow direction the gas enters on the right side of the machine through the right manifold 230 and exits on the left side of the compressor and flows out through the left manifold 240.

Operationally, the machine shown in FIG. 4*c* stops and the rotor vane assembly 140 and 145 reverses to clockwise rotation. The gas enters right manifold 230, pressurizing left manifold 240, causing the reed control rod 180 to move right, forcing the right reed valve 200R open against right reed stop 210R, and opening the right inlet port 250R. Simultaneously, the right end of vane reed control rod 180 fully disengages the left reed valve 200L because of the pressure difference developing across the respective ends of the reed control rods 180. The gas passes through the left manifold region 240 delivering the hot gas, for example, to the outside condenser 40 as shown in FIG. 1*a*.

Figure 5B:
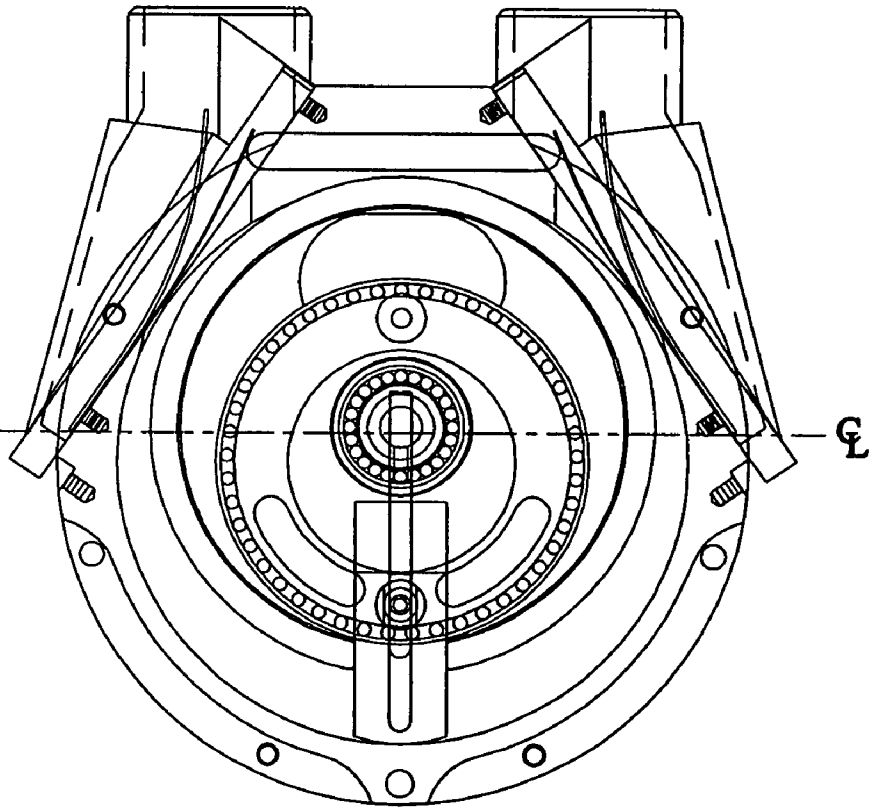
FIG. 5*b* shows a reversing valve system applied to a MonoVane compressor.
Figure 5A:
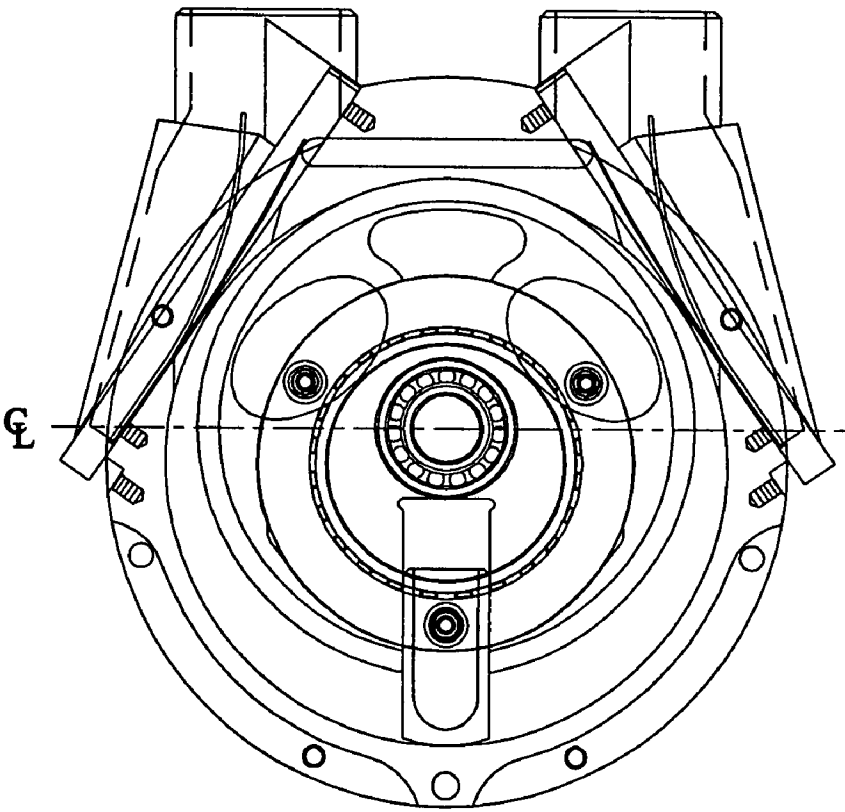
FIG. 5*a* shows a reversing valve system applied to a UniVane® compressor in its neutral position.
Figure 5C:
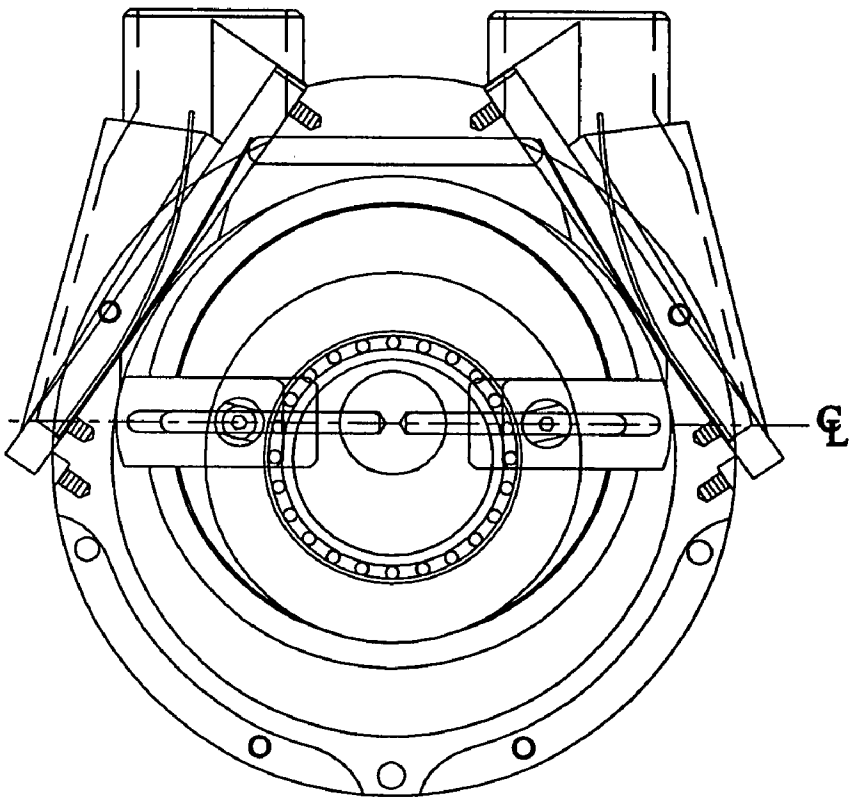
FIG. 5*c* shows a reversing valve system applied to one embodiment of a DuoVane compressor.
Figure 5D:
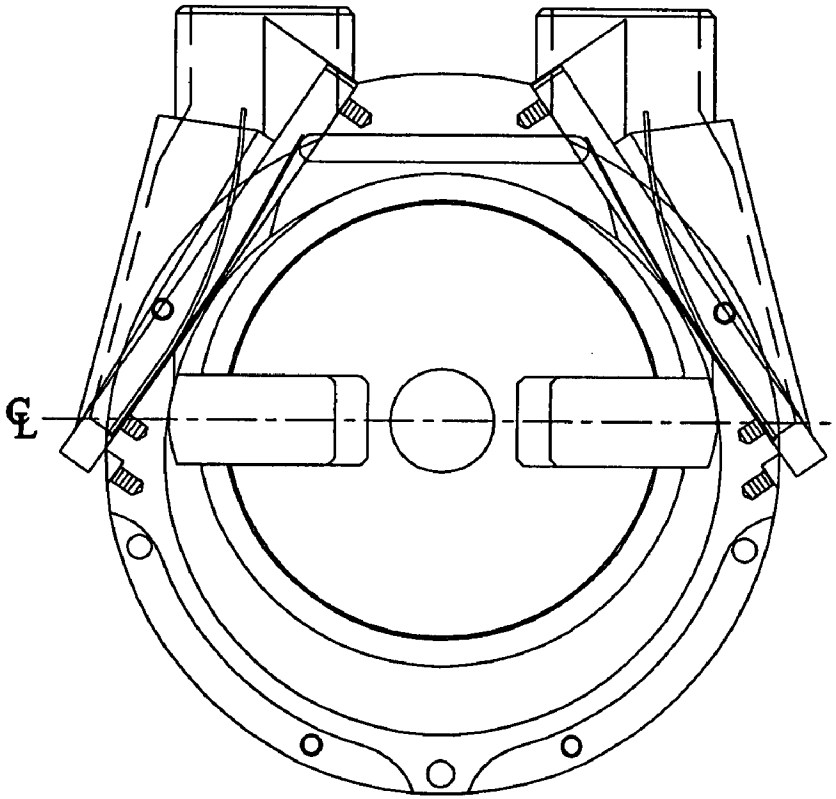
FIG. 5*d* shows a reversing valve system applied to a conventional rubbing vane compressor.

FIGS. 5*a*, 5*b*, 5*c* and 5*d* show the machine in the 'neutral' position with reversible-flow valving system of the present invention fitted on three different types of compressors. Respectively, FIGS. 5*a-d* show the reversible-flow valving system of the present invention in a UniVane® compressor (FIG. 5*a*), a MonoVane compressor (FIG. 5*b*) and a second version of the DuoVane compressor (FIG. 5*c*) wherein the roller bearings are located within the vane rings rather that the outside as shown in FIGS. 2*a* and 3*a*. FIG. 5*d* shows the valving system installed on a conventional two-vane contact compressor.

In the outer vane ring DuoVane embodiment shown in FIG. 5*c*, smaller roller bearings are situated on central concentric hubs located on the endplates and the roller bearings are pressed into concentric recesses of the endplates rather than concentric hubs thus having the vane rings inside the roller bearings.

Figure 6A:
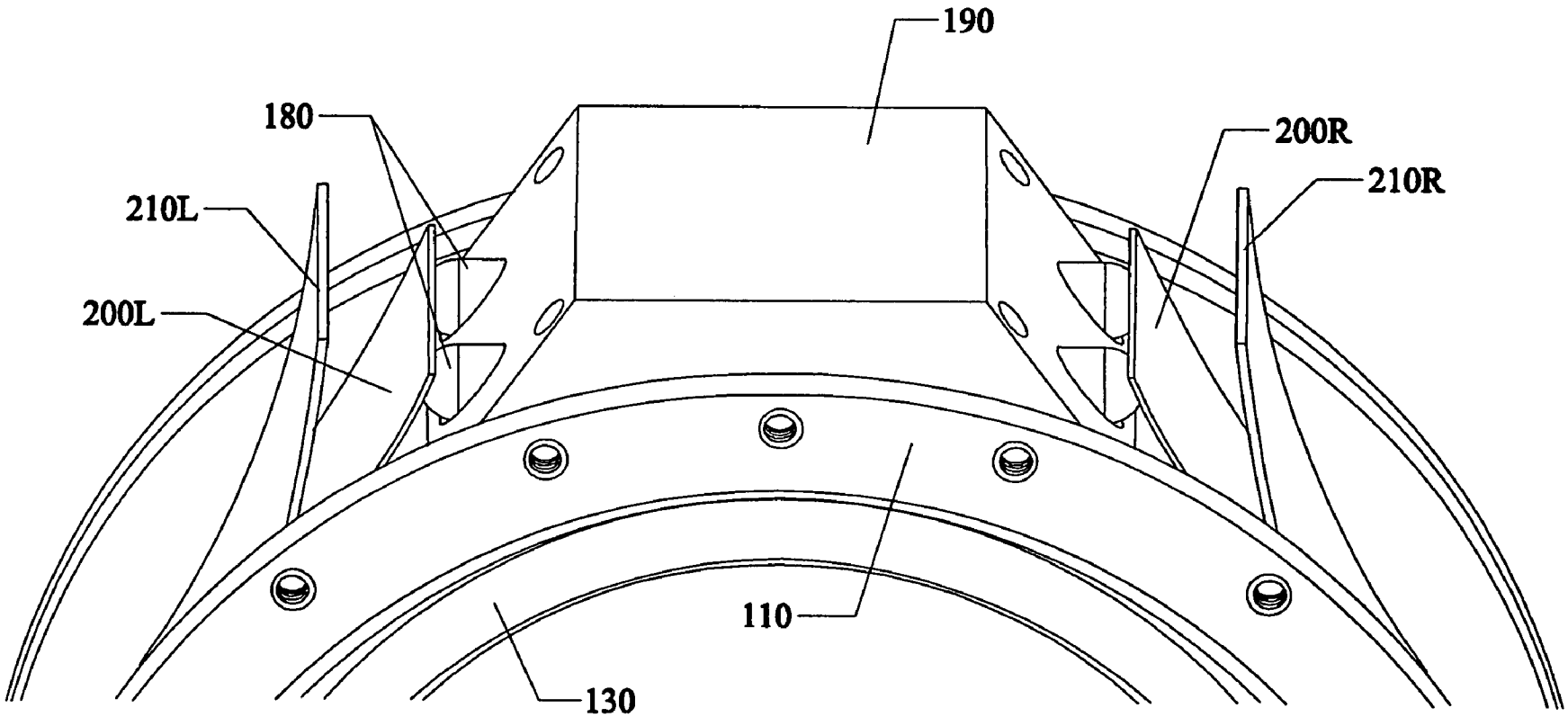
FIG. 6*a* shows a partial three-dimensional view of the compressor of FIG. 4*a* with the rotor and vane subassembly in a neutral position.
Figure 6B:
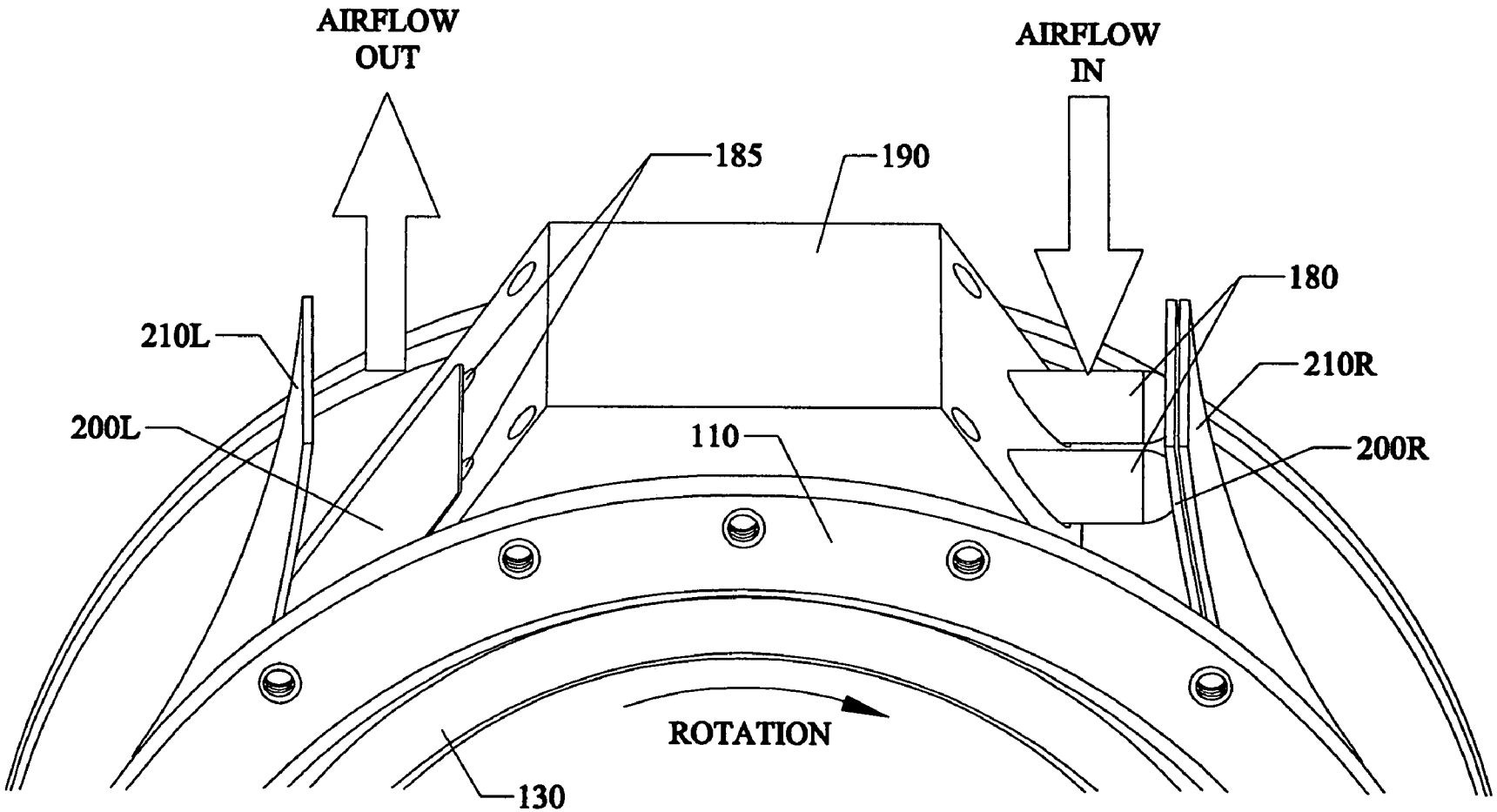
FIG. 6*b* shows a partial three-dimensional view of the compressor of FIG. 4 with the rotor and vane assembly rotating clockwise.
Figure 6C:
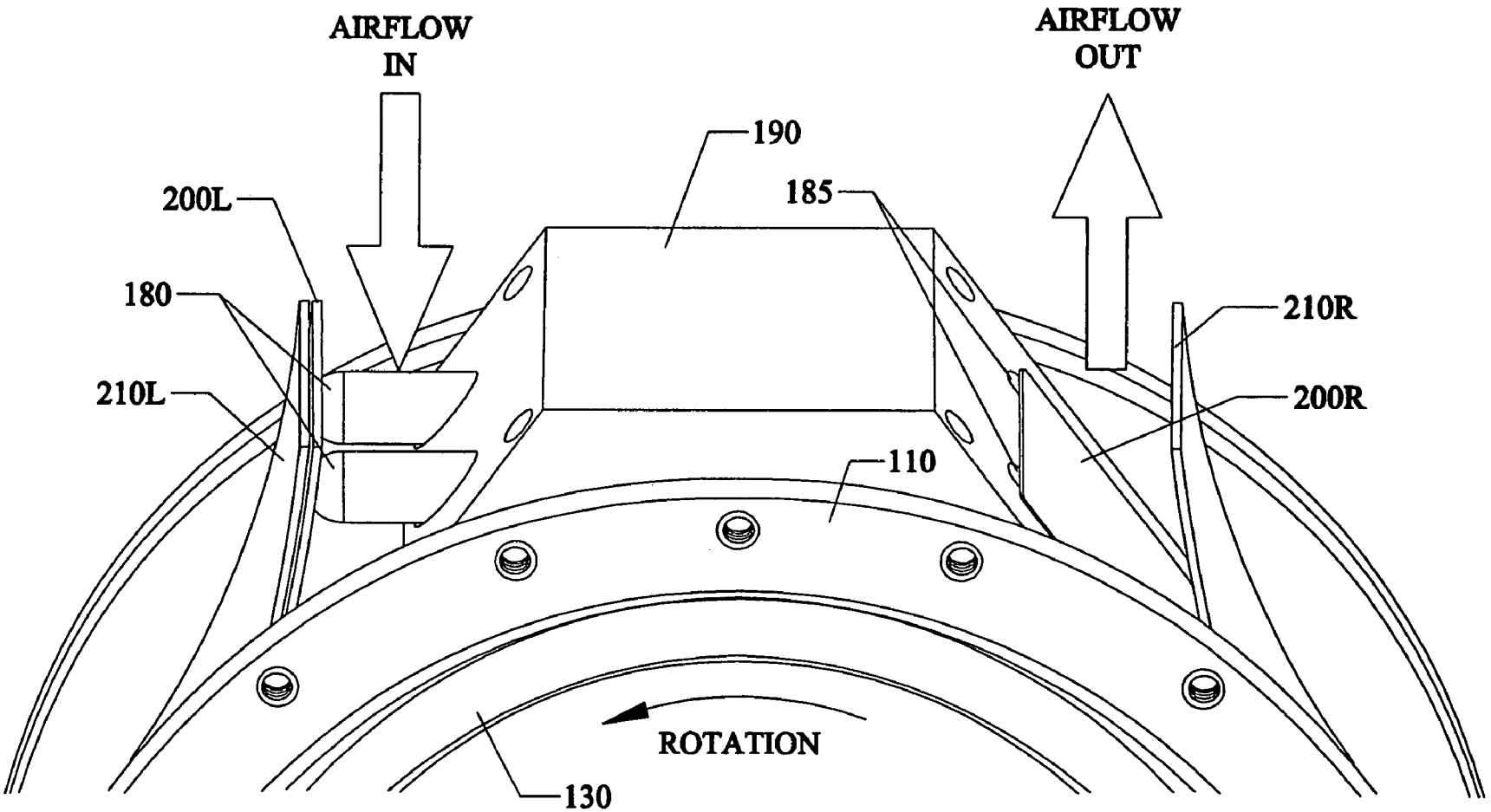
FIG. 6*c* shows a partial three-dimensional view of the compressor of FIG. 4*a* with the rotor and vane assembly in rotating counter-clockwise.

FIGS. 6*a*, 6*b* and 6*c* show partial 3-dimensional views of the reversible valving system in neutral, clockwise rotation and counter-clockwise rotation, respectively, and the views are shown independent of the specific type of compressor configuration.

As shown in FIG. 6*a*, the machine includes a stator body extension 190 for housing the reed control rods 180 which move within the slidable passage 185. When the rotor vane assembly is in neutral with the rotor 130 and corresponding vane assembly (not shown) stationary, the reed control rods 180 are held in an approximately central position because of the spring forces applied by the right and left reed valves 200R, 200L. This partially-open port condition allows the machine to begin operational in either a clockwise or a counter-clockwise direction.

In FIG. 6*b*, the rotor 130 and vane assembly (not shown) are rotating clockwise and gas enters the left side of the machine during start-up and the differential pressure therefore builds on the left side of the compressor. This elevated pressure then pushes the reed control rods 180 to the right the right reed valve 200R contacts the right reed valve stop 210R, fully opening the inlet port 250R (not shown). Conversely, the control rods 180 are pushed away from the left reed valve 200L for normal operation.

As shown in FIG. 6*c*, rotor 130 and vane assembly is rotating counter-clockwise, increasing the pressure on the right side of the compressor so the left reed valve 200L is pushed by control rods 180 against the left reed stop 210L due to the increased pressure on the right side.

Figure 7A:
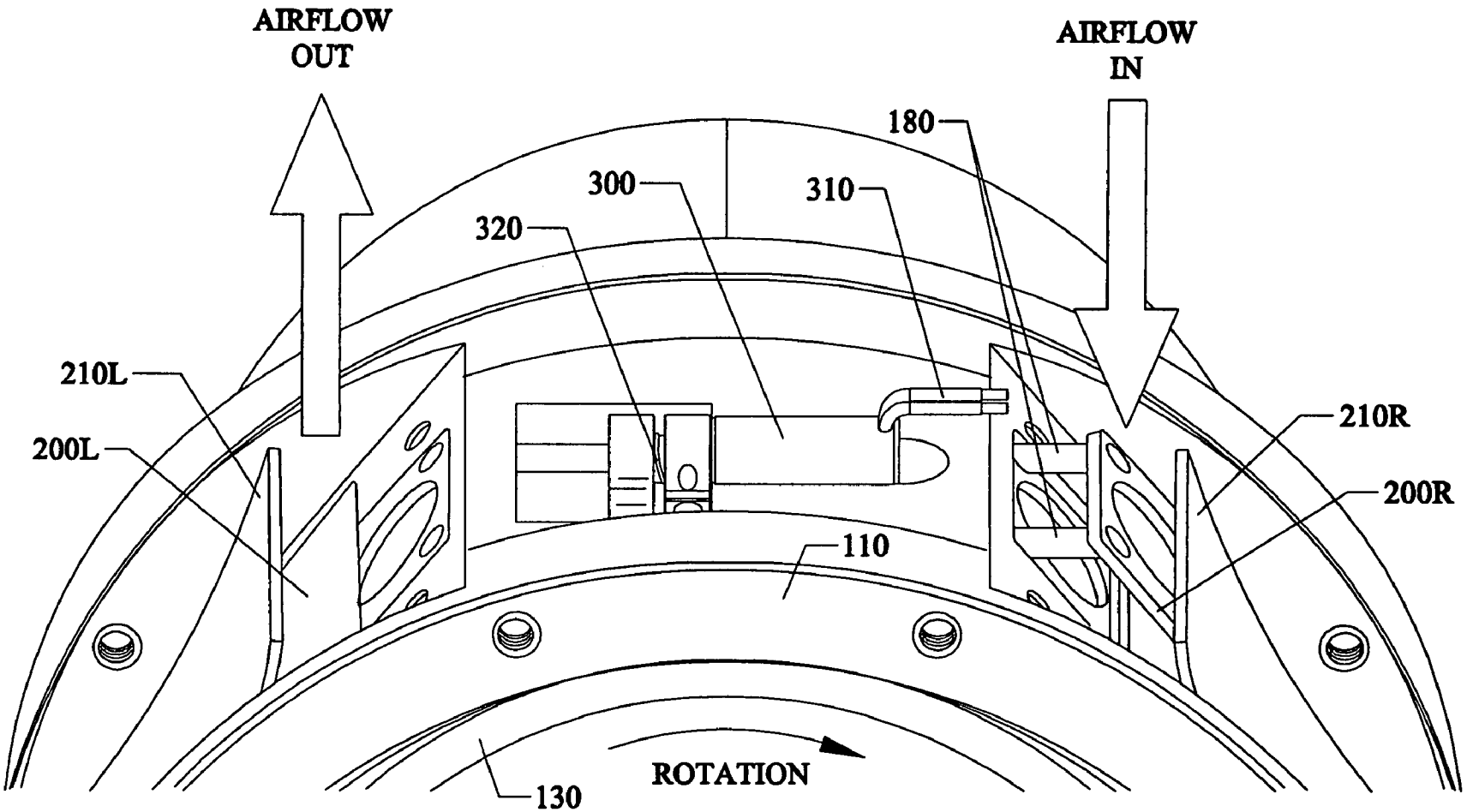
FIG. 7*a* shows a partial three-dimensional view of a valve-activating electric solenoid showing the rotor and vane subassembly rotating in the clockwise direction.
Figure 7B:
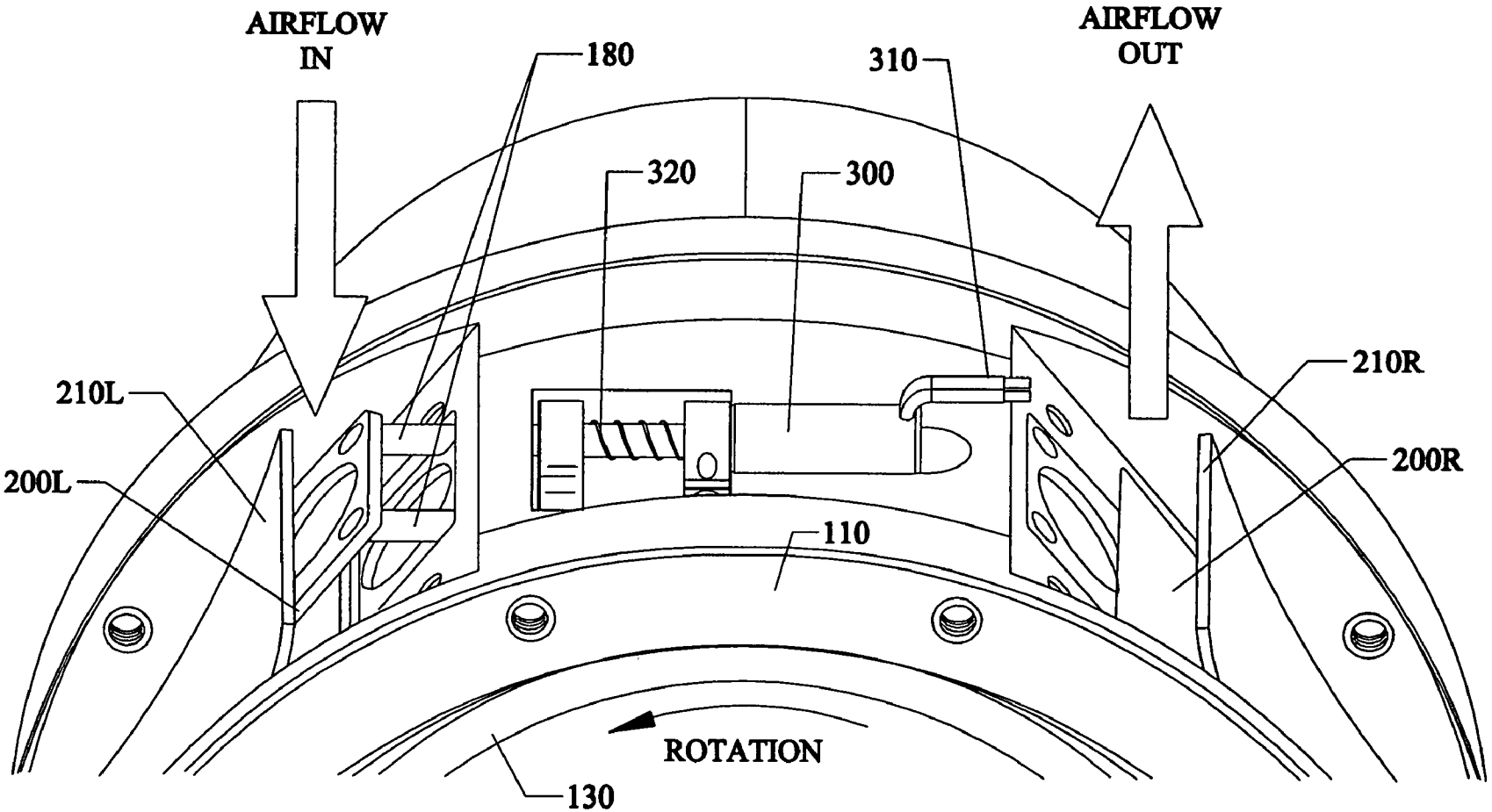
FIG. 7*b* shows a partial three-dimensional view of a valve activating electric solenoid showing the rotor and vane subassembly rotating in the counter-clockwise direction.

FIGS. 7*a* and 7*b* are partial 3-dimensional views showing the reversible valving system of the present invention according to a second embodiment. In this embodiment, the reversible valving system is not based upon automatically-generated pressure differences as described above, instead switching, i.e. flow reversing, is achieved using spring-loaded electro-magnetic solenoids that, via electronic/electrical command, shift the reed control rod 180 right and left to accomplish compressor flow-reversibility.

FIGS. 7*a* and 7*b* show the electric solenoid 300 mounted within the top region 190 of the compressor. Depending upon whether electricity is supplied or not to the spring-actuated solenoid 300, the reed control rods 180 are moved right and left, depending upon the rotational direction of the rotor 130. For example, if solenoid current is not supplied to the solenoid 300, return spring 320 shifts the left reed valve 200L open against the left valve stop 210L, permitting reversed compressor flow as shown in FIG. 7*b*. The opposite then occurs when electricity is applied to the solenoid because the electro-magnetic field of the solenoid overcomes the opposing forces. As shown in FIG. 7*a*, when solenoid current is supplied to the solenoid 300, return spring 320 shifts the right reed valve 200R open against the right valve stop 210R, permitting forward compressor flow The reversible valving system of the present invention has been described and illustrated, with two identical reed control rods 180 slidably inserted with minimum clearance in passages 185 located in the compressor body extension 190 integrated with the stator body 110 as shown in FIGS. 6*a-c* and 7*a-b*. As previously described, this extension may be integral to the stator body casting, and alternatively, the compressor body extension 190 can be attached to the compressor stator body 110 by other techniques known to the art.

Figure 8A:
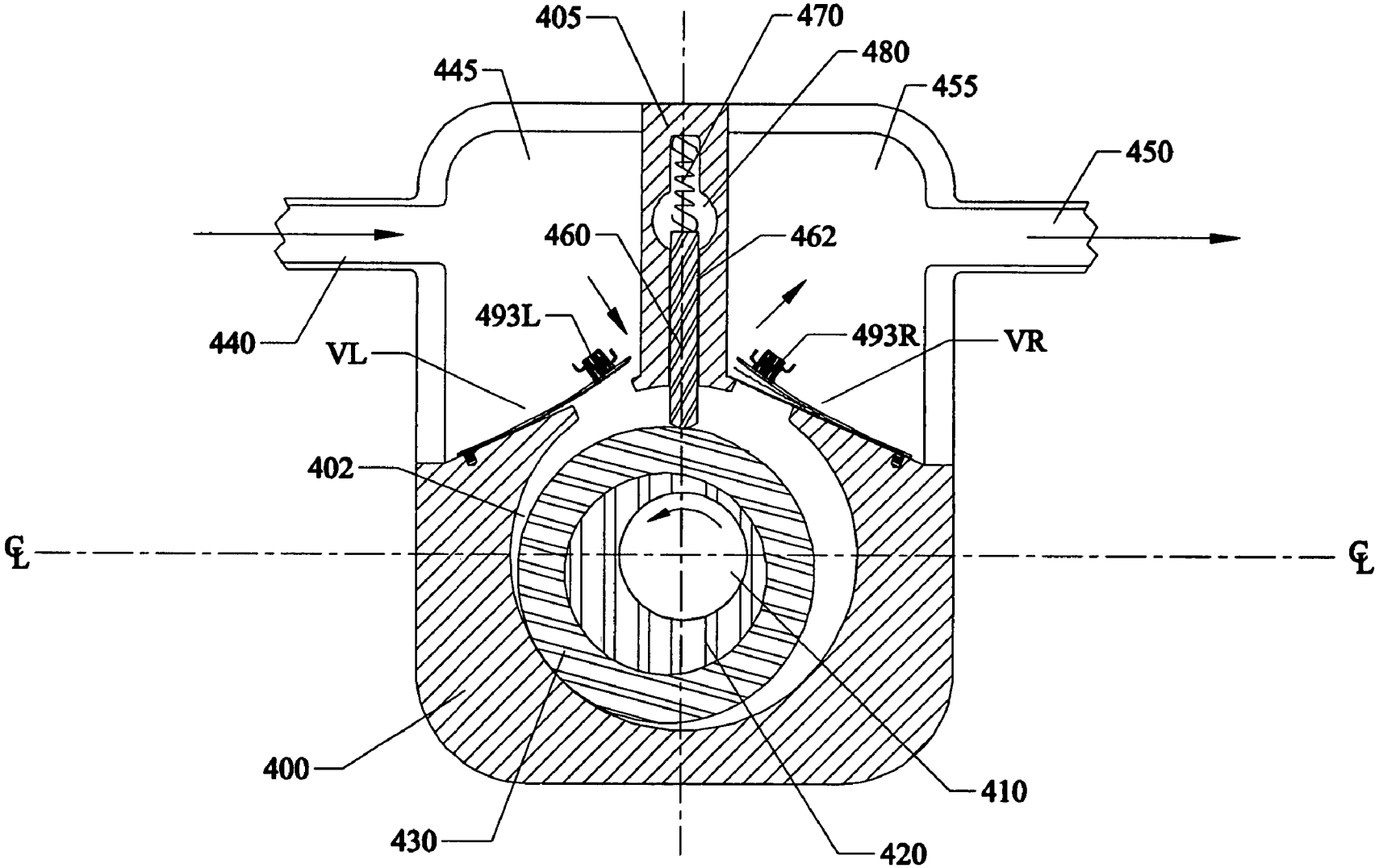
FIG. 8*a* shows an end-view reversible embodiment of a conventional rolling piston compressor operating in the counter-clockwise direction through the activation of an electromagnet.
Figure 8B:
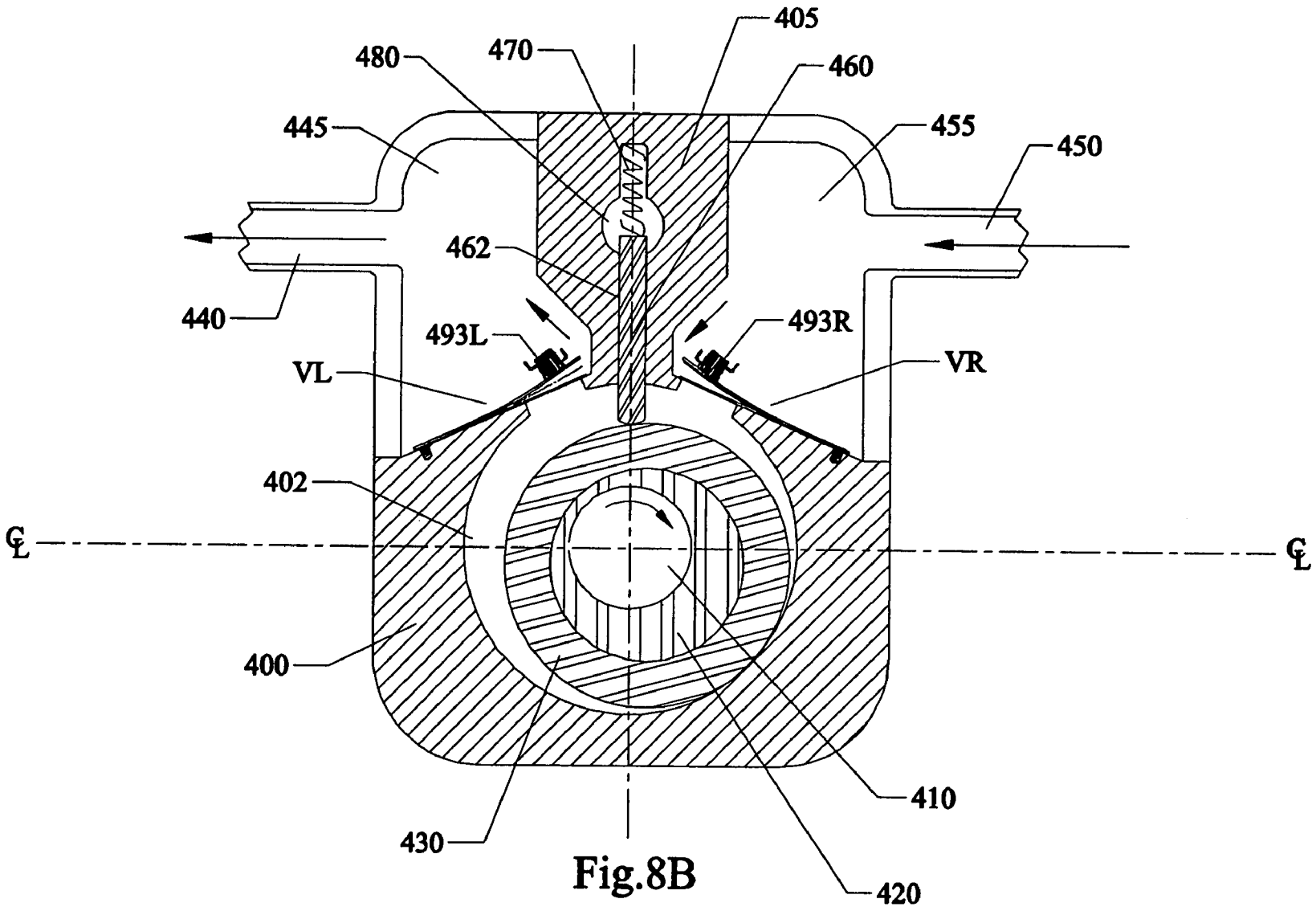
FIG. 8*b* shows an end-view reversible embodiment of a conventional rolling piston compressor operating in the clockwise direction through the activation of an opposite electromagnet.
Figure 8C:
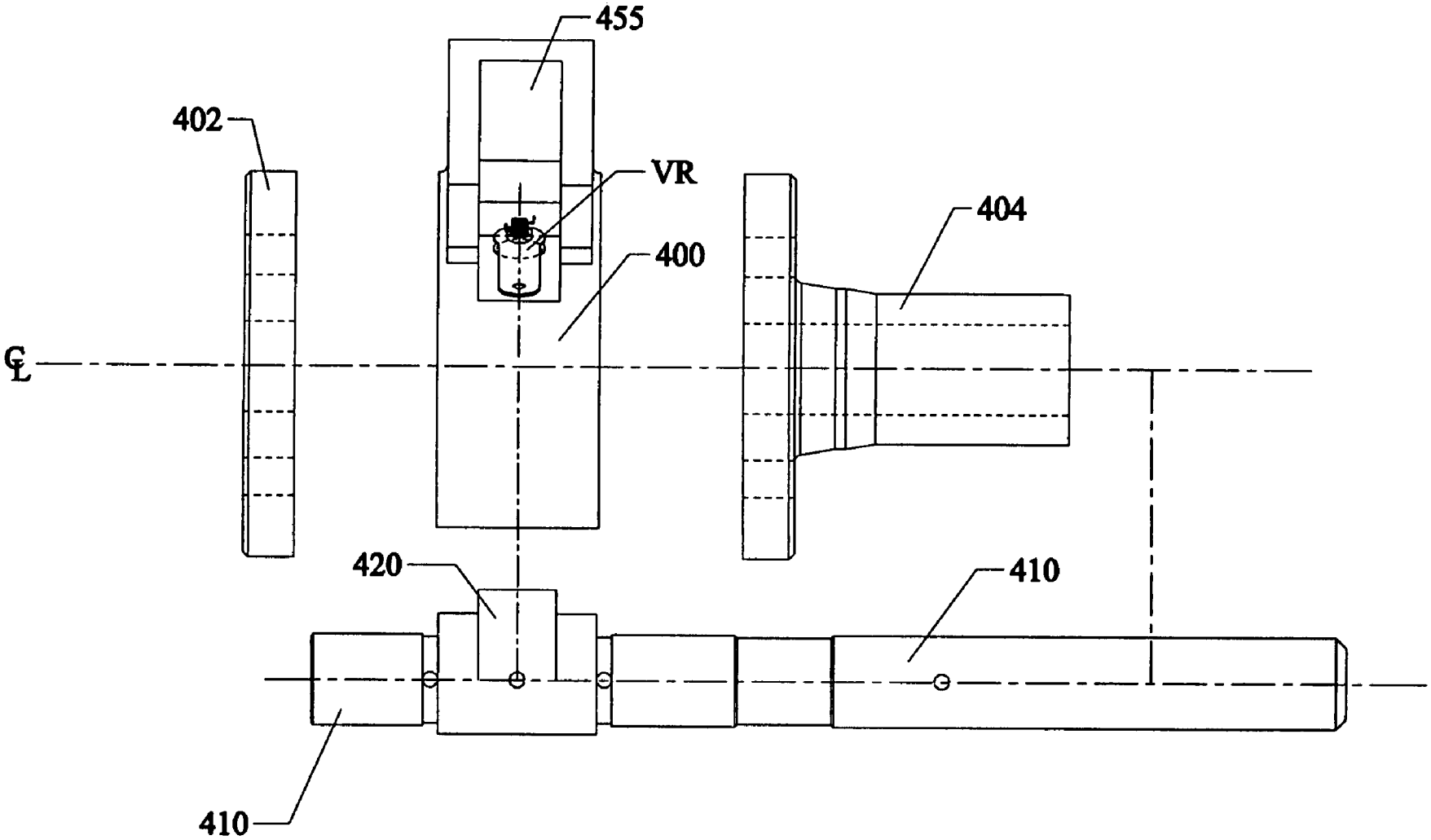
FIG. 8*c* shows a partial and expanded side-view of various components of the reversible rolling piston compressor.
Figure 8D:
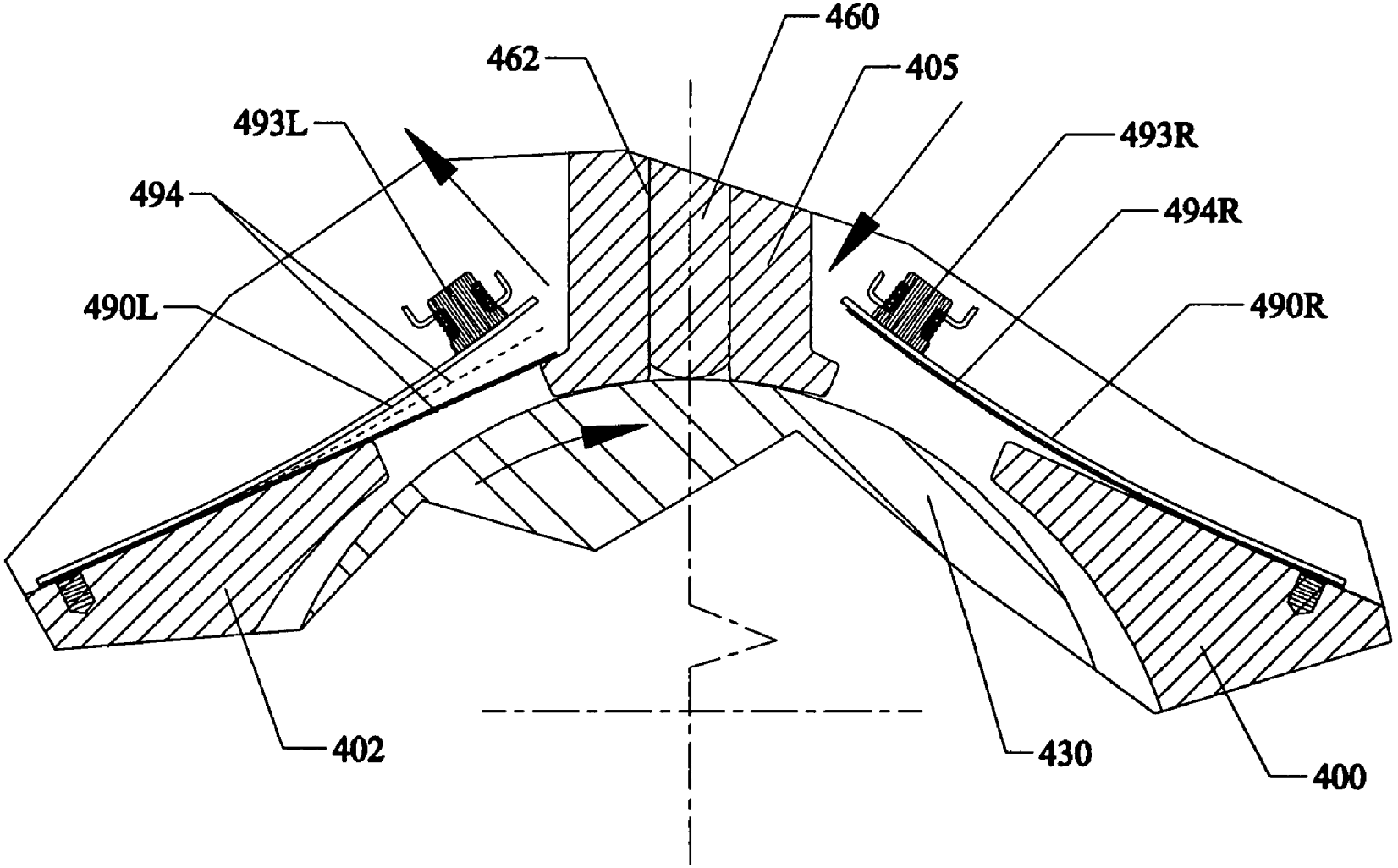
FIGS. 8*d* and 8*e* are magnified views of the reversible valve assemblies of the reversible rolling piston compressor.
Figure 8E:
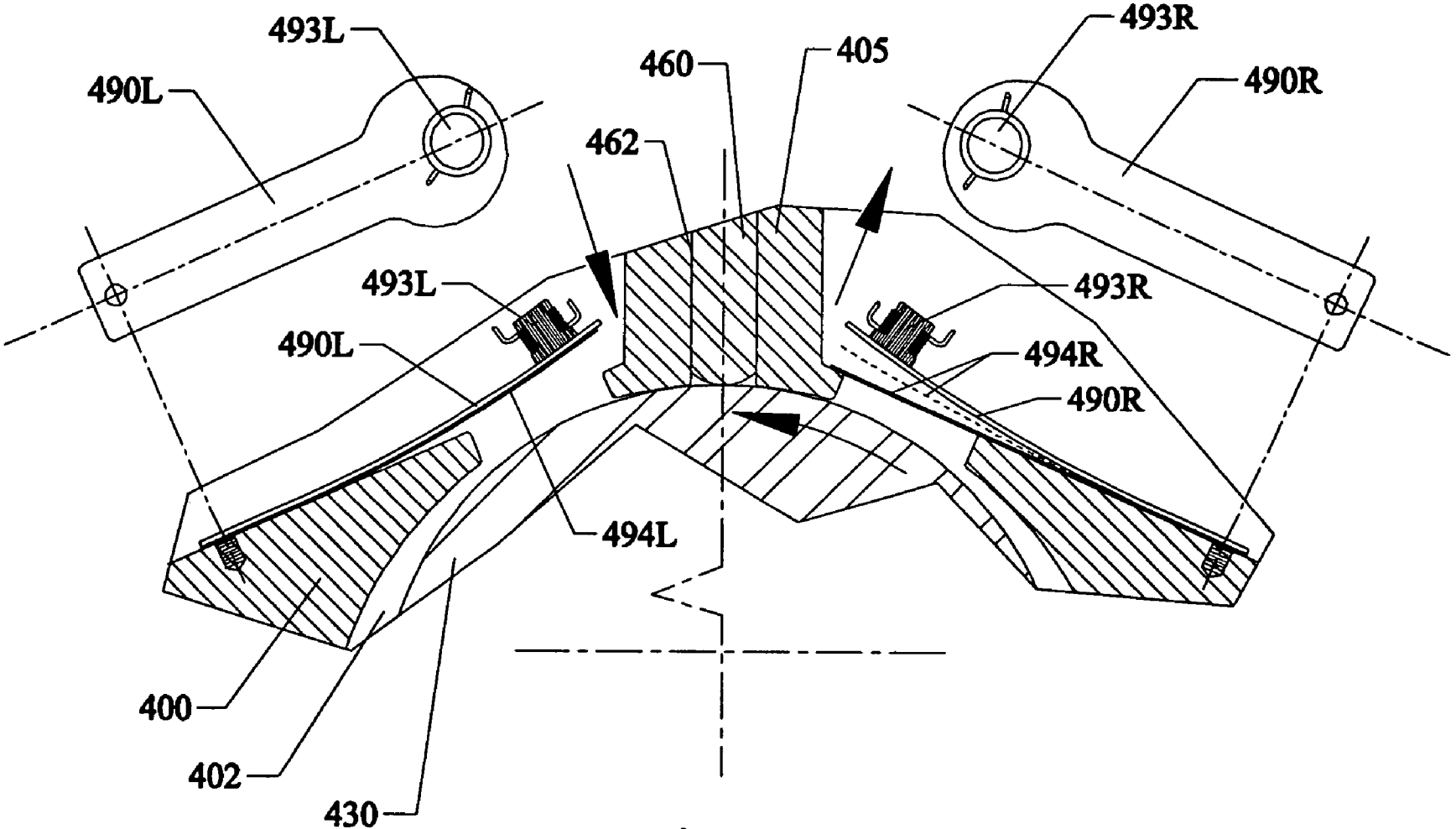
Figure 8F:
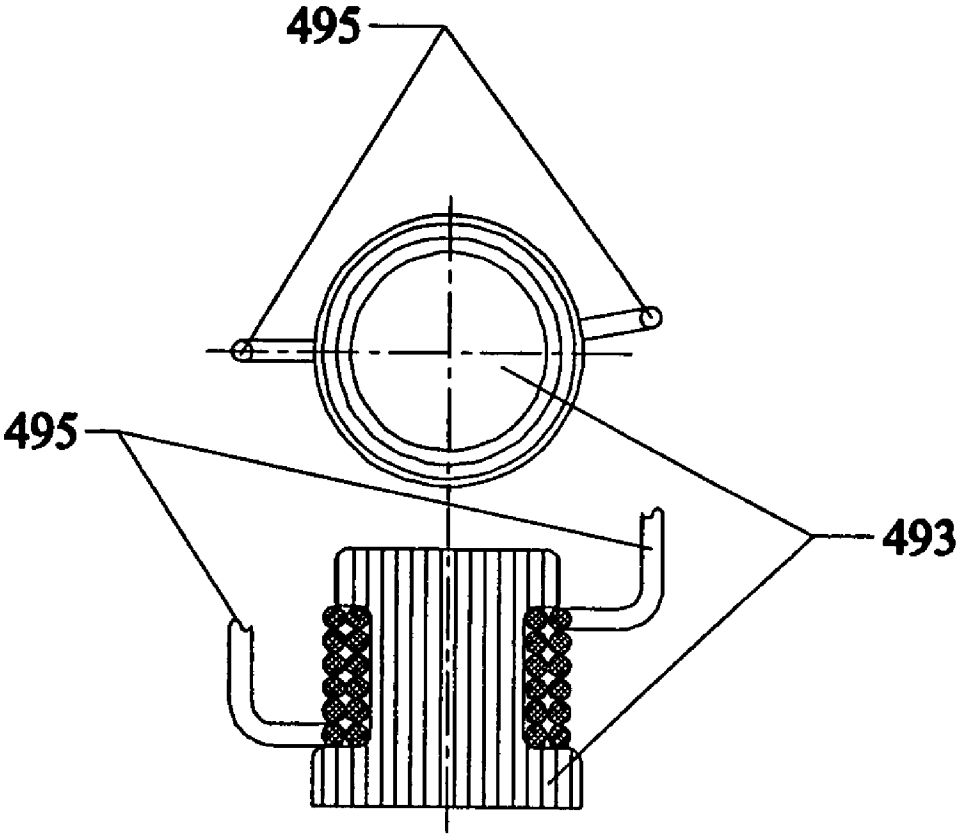
FIG. 8*f* shows a magnified view of the reed valve electromagnets.

FIGS. 8*a-e* show another embodiment for reversing the flow. In this embodiment, the compressor is a conventional compressor known as a rolling piston compressor. FIGS. 8*a-b* and the magnified partial views shown in FIGS. 8*d-e* are front views of the rolling piston compressor while FIG. 8*f* shows a magnified view of the electromagnetic reed valve lifter.

As shown in the FIGS. 8*a-e*, the rolling piston compressor consists of a stator body 400, a drive shaft 410, an eccentric feature 420 integral with rotor drive shaft 410, a reciprocating vane 460 coupled with the outside diameter of the rolling piston 430 is shown oscillating vertically with corresponding slot 462 placed in the vane control guide 405. Spring 470 and hydraulic pressure distributed by hole 480 to the top of the vane 460.

Referring specifically to FIGS. 8*b-f* wherein the compressor is shown operating clockwise, right electro-magnet 493R is mounted near the end of right reed valve back-up plate 490R and left electro-magnet 493L is mounted near the end of left reed valve back-up plate 490L. Electrical power for the electro-magnet is applied to leads 495 and through coil. The magnetic field generated by the activated right electromagnet 493R lifts the right ferrous reed valve 494R against the right reed back-up plate 490R and keeps the left port in stator 400 fully open for incoming gas or fluid. When electric current is not applied to left electromagnet 493L, left reed valve 494L operates normally.

The compressor shown in FIGS. 8*a-e* is operating in the counter-clockwise direction. In this example, the left electro-magnet 493L is activated and right electro-magnet 493R is turned off. Thus, the electromagnetic force generated by left electro-magnet 493L pulls left reed valve 494L against left reed valve stop 490L, opening the left port in the stator 500 for incoming fluid or gas.

Figure 9A:
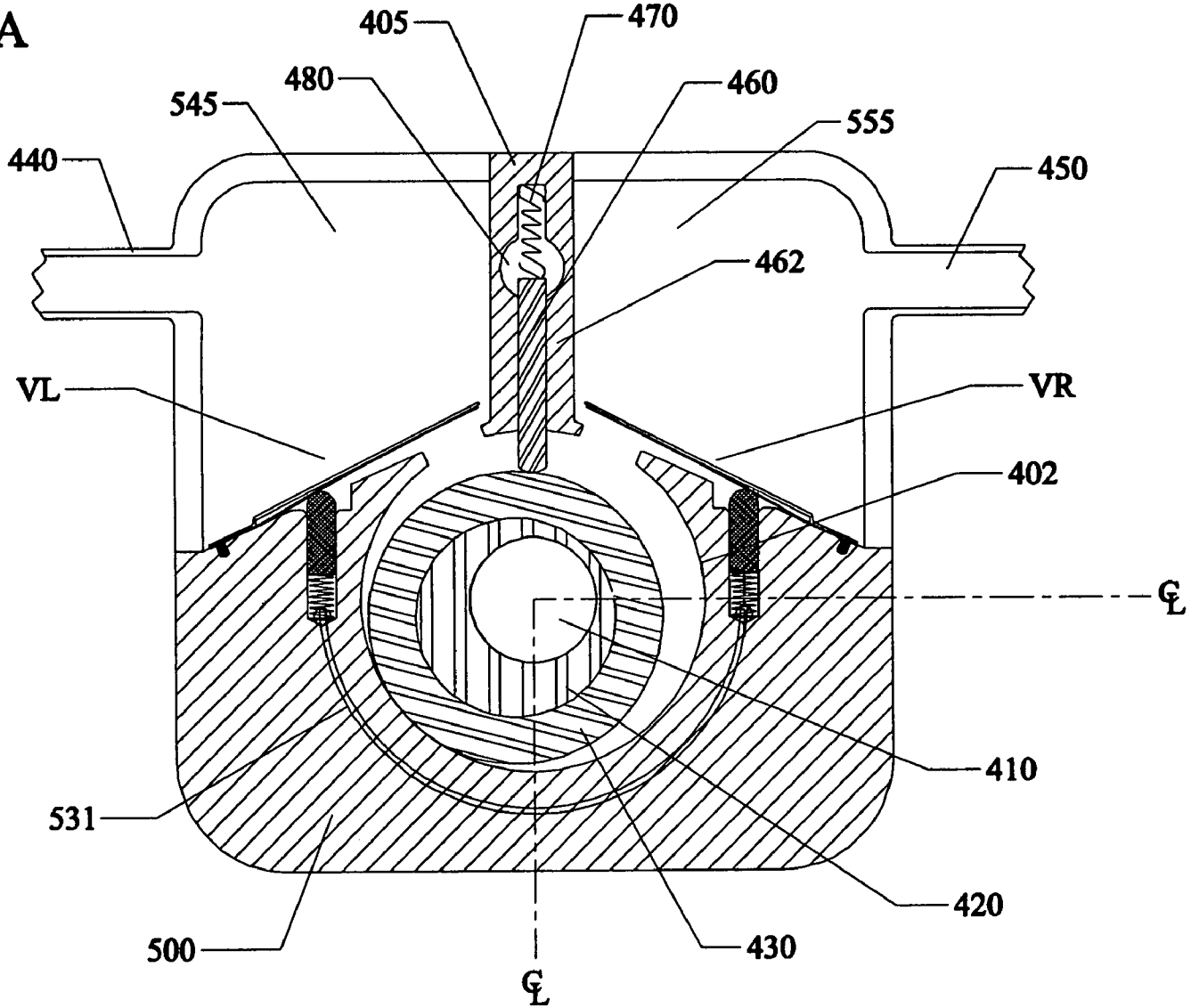
FIG. 9*a* is a front view of the automatic pressure flow reversible rolling piston compressor in a static non-operating mode.
Figure 9B:
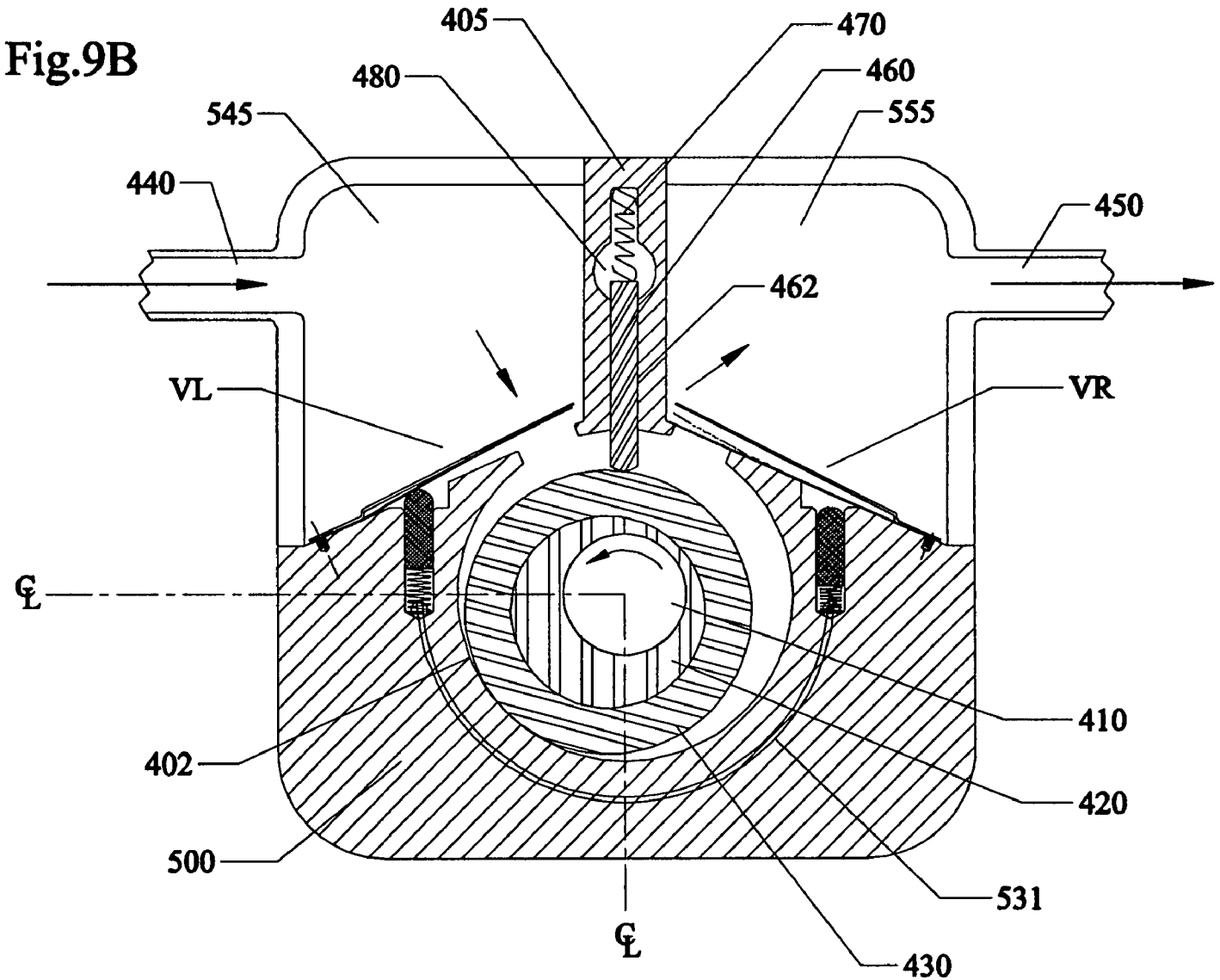
FIG. 9*b* shows the compressor of FIG. 9*a* operating in a counter-clockwise direction.
Figure 9C:
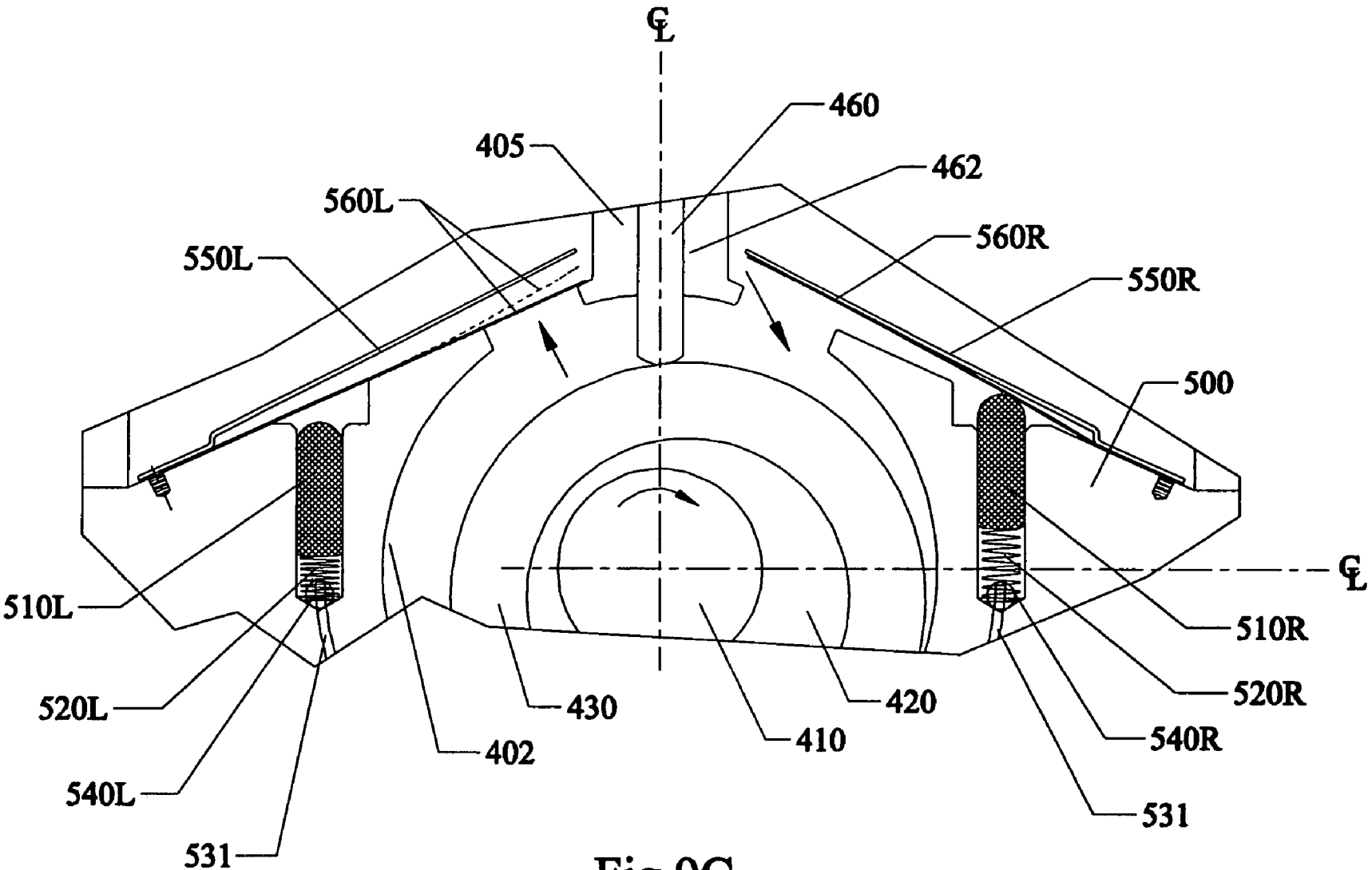
FIG. 9*c* shows the compressor of FIG. 9*a* operating in clockwise direction.
Figure 9D:
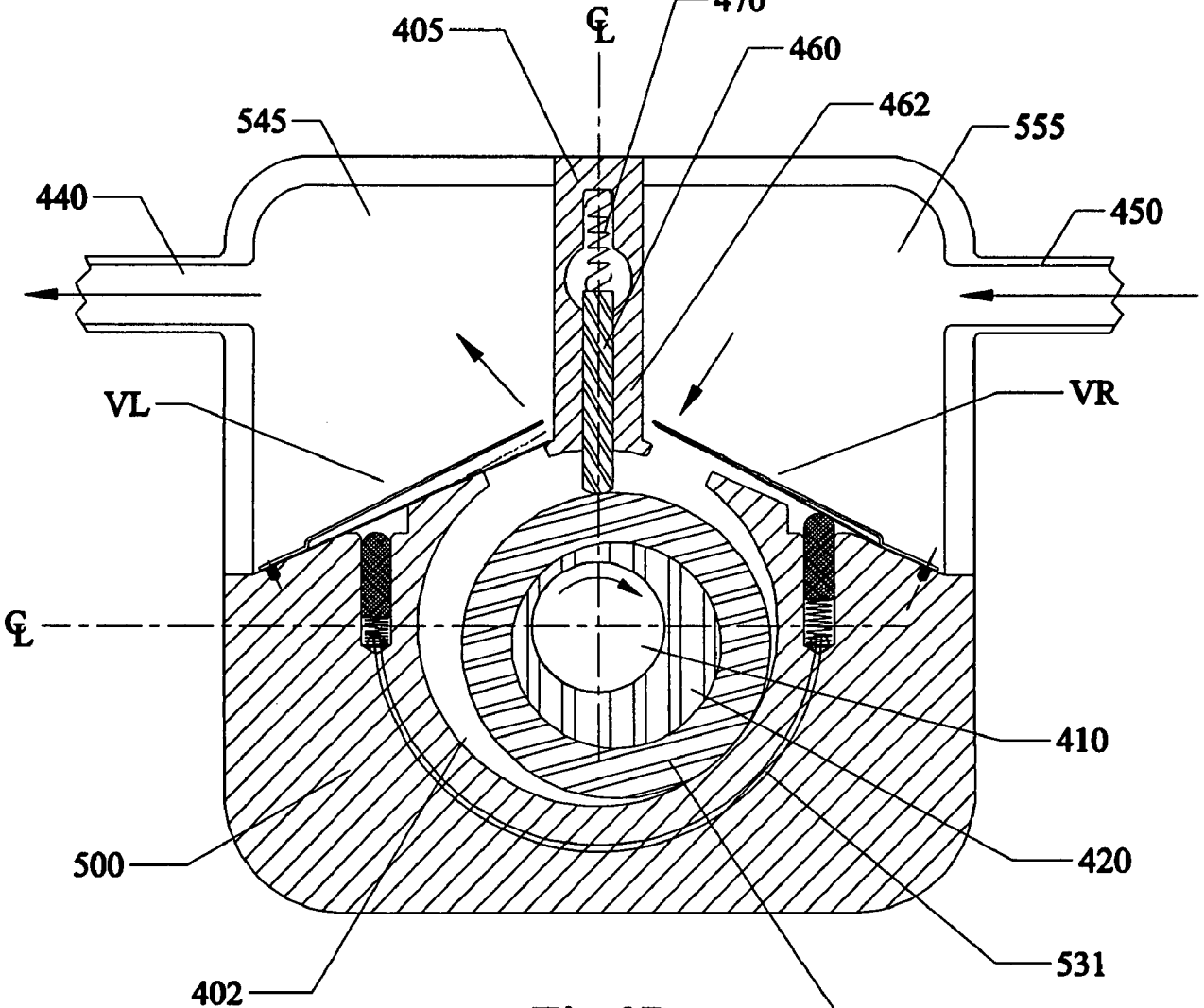
FIG. 9*d* is a magnified view of the reversible valving arrangement for standard rolling piston compressor.

FIGS. 9*a-d* show a reversible flow compressor that operates automatically according to the compressor's pressure difference similar to the embodiment shown in FIGS. 2-6. FIG. 9*a* shows the rolling piston compressors in neutral wherein the rotor 410 is not moving while FIGS. 9*b* and 9*c* shows the compressor operating in the counter-clockwise direction and clockwise direction, respectively. FIG. 9*d* is a magnified view of the automatic reversing valve system operating in the clockwise direction.

When the compressor is not operating the compressor does have a pressure differential. In this state, the left and right reed valve control pins 510L and 510R located in the stator body hold the left and right reed valves 560L and 560R open in conjunction with the left and right springs 520L and 520R. In the open position, the reed valves 560L and 560R are in contact with left and right reed back-up plates 550L and 550R in the left and right manifolds 545 and 555, respectively, to keep both stator ports open for operation in either direction.

FIGS. 9*c* and 9*d* show the rotor shaft 410 is rotating in the clockwise direction causing the eccentric 420 and the rolling piston 430 to roll around the circular interior surface of the stator 500, also in the clockwise direction. As the rotor shaft 410 continues to rotate, pressure begins to develop on the left side. As the pressure increases, the round end of reed control pin 510L reacts to the increase in pressure by receding against spring 520L, which in this example is a light force spring. The low pressure transmitted through the small leakage between the reed valve control pin 510 and the small passage 531 in the stator 500 working with axial holes 540L and 540R that are drilled, say, about half-way through the stator 500 such that the fluidly-connect with the bottoms of both the reed control pins 510F and 510R and the pressure transmission passage 531. Passage 531 could take many forms. In the example shown, the axial holes are semi-circular in shape and are only several thousandths of an inch in depth. While the axial holes are shown in the stator 500, alternatively, they could be located in the internal face of one or both of the endplates.

The increased pressure underneath right reed control pin 510R, along with the force from the right spring 520R, causes the right reed valve control pin 510R to move upwards, forcing the right reed valve 560R to an open position. The right valve stop 550R prevents over extension of the right reed valve 560R. The open position allows the entry of gas into the compressor to be compressed. Left reed valve control pin 510L is forced downwards and away from left reed valve 560L. When the rotor shaft reverses rotation, the left reed valve 560L is forced open, reversing the flow delivery.

In summary, the present invention provides novel methods, systems, apparatus and devices to provide a reversible valving system for switching from a compressor inlet port to the compressor output port by reversing the rotational direction of the compressor. The reversible valving system includes a valving systems coupled with both sides of the compressor body, reversible flow ports installed in the stator, manifolds on each side of the compressor enclosing the reed valves and ports, and control element in the stator housing. The control element moves from one side to the other side. In one embodiment, the control element movement is due to pressure build-up. In a second embodiment, the control element movement is actuated by applying current to a solenoid.

The preferred embodiments of the present invention have been described and illustrated with specific embodiments, hardware, structures and constructions that are capable of resulting in actual machinery that achieves a true reversible flow compressor. Those skilled in the art will understand alternative hardware, structure and configurations may be substituted to achieve the reversal compressor flow.

While the invention has been described, disclosed, illustrated and shown in various terms of certain embodiments or modifications which it has presumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

I claim:

1. A reversible compressing device consisting essentially of:

a reversible drive motor for reversing a rotational direction of a rotor rotating within a stator having a stator body extension in one portion of the stator;

a first and a second flow port located in a left side and a right side of said stator, respectively;

a first and a second manifold located on said right side and said left side of said stator, respectively, said first and said second manifold enclosing a corresponding one of a first inlet valve and first flow port and a second inlet valve and second flow port, wherein said first and said second inlet valve are moveable between an open and a closed position; and an actuator movably located in a passageway of the stator body extension between said first and said second manifold for automatically moving one of said first and said second inlet valve to said open position to open a corresponding one of said first port and said second port for flow corresponding to the rotational direction of said rotor, in neutral operation the actuator is centered partially opening each of the first and second inlet valve until rotation in one of a clockwise and a counter-clockwise direction creates a pressure in a corresponding one of the right and left manifolds automatically moving the actuator to move the one of the left and right inlet valves to open the one of the left and right inlet ports and the opposite one of the left and right inlet valve functions normally to open when pressure increases above pressure in the opposite side to allow pressure to exit.

2. The reversible compressing device of claim 1 wherein each of said first and said second inlet valve comprise:

a movable reed valve, wherein when said movable reed valve is in an open position a gas enters into a corresponding one of said first and said second manifold and exits an opposite one of said first and said second manifold.

3. The reversible compressing device of claim 1 wherein said actuator comprises:

a solenoid for switching one of said first inlet valve and said second inlet valve to said open position and an opposite one of said first inlet valve and said second inlet valve to said closed position, wherein said open position corresponds to said inlet position;

an electrical source for supplying a current to said solenoid for activating said solenoid.

4. The reversible compressing device of claim 1 wherein said actuator comprises:

a pressure-activated rod movably located in a passageway, wherein said pressure-activated rod automatically moves to one of a first position and a second position corresponding to said rotational direction of said rotor.

5. A reversible valving system for reversing a flow within a compressing device comprising:

a rotor rotating in one of clockwise and a counter-clockwise rotational direction within a stator housing;

a movable actuator connected with said stator housing between a right and a left manifold, said actuator movable between a first position and a second position corresponding to said rotational direction of said rotor, said right and said left manifold coupled with said stator housing;

a right and a left valve enclosed in said right and said left manifold, respectively, wherein said actuator moves said right and left valve between an open position and a closed position according to said rotational direction of said rotor for flow into and out of said stator housing; and a right compressor inlet port and a left compressor inlet port on opposing sides of said stator housing automatically switchable between an open position and a closed position by the moving one of said right or left valve, respectively, according to said rotational direction of said rotor, in neutral operation the actuator is centered partially opening each of the right and left inlet valve until rotational pressure moves the actuator to move one of the left and right valves to open a corresponding one of the left and right compressor inlet ports and the opposite one of the left and right inlet valve functions normally to open when pressure increases above pressure in the opposite side to allow pressure to exit.

6. The valving system claim 5 wherein said actuator comprises:

a solenoid for moving said actuator between said first position and said second position;

an electrical source for supplying a current to said solenoid for actuating said solenoid.

7. The reversible valving system of claim 5 wherein said actuator comprises:

pressure-activated rod movably located in a passageway, wherein said pressure-activated rod automatically moves to one of said first position and said second position corresponding to said rotational direction of said rotor.

8. The reversible valving system of claim 5 wherein said right and said left valve comprise:

a right and a left flexible reed valve.

9. The reversible valving system of claim 8 further comprising:

a right and a left valve stop coupled with said right and said left flexible reed valve, respectively, to prevent overextension.

10. The reversible compressing device of claim 5 wherein said compressing device comprises:

a MonoVane compressor having one single vane.

11. The reversible compressing device of claim 5 wherein said compressing device comprises:

a DuoVane compressor having two vanes.

12. The reversible compressing device of claim 5 wherein said compressing device comprises: a rolling piston compressor.

* * * * *